US011009234B2

(12) United States Patent
Adams et al.

(10) Patent No.: US 11,009,234 B2
(45) Date of Patent: May 18, 2021

(54) HOME COOKING APPLIANCE HAVING A PEDESTAL BURNER

(71) Applicant: BSH Home Appliances Corporation, Irvine, CA (US)

(72) Inventors: David Adams, Norris, TN (US); Ben Braden, Lafollette, TN (US); Russell Dorsten, Knoxville, TN (US); Jonathan Grey, Huntersville, NC (US); Donald Hendricks, Caryville, TN (US); Chris Hill, Arlington, TX (US); David Nowak, Powell, TN (US); Timothy Russell, Jacksboro, TN (US); Graham Sadtler, Huntington Beach, CA (US); Phil Springer, Aliso Viejo, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 241 days.

(21) Appl. No.: 15/968,827

(22) Filed: May 2, 2018

(65) Prior Publication Data

US 2018/0252407 A1 Sep. 6, 2018

Related U.S. Application Data

(63) Continuation of application No. 15/158,766, filed on May 19, 2016, now Pat. No. 10,690,351, which is a (Continued)

(51) Int. Cl.

| | |
|---|---|
| ***F24C 3/00*** | (2006.01) |
| ***F24C 3/08*** | (2006.01) |
| ***F23D 14/06*** | (2006.01) |

(52) U.S. Cl.

CPC ..... *F24C 3/082* (2013.01); *F23D 14/06* (2013.01); *F23D 2900/14042* (2013.01); *F23D 2900/14064* (2013.01)

(58) Field of Classification Search

CPC ..... F23D 14/06; F23D 2900/14064; F23D 2900/14042; F24C 3/082

See application file for complete search history.

(56) References Cited

U.S. PATENT DOCUMENTS 2,023,624 A 12/1935 Tullis
2,344,144 A 3/1944 Hobson
(Continued)

FOREIGN PATENT DOCUMENTS

EP 0581655 A1 2/1994

OTHER PUBLICATIONS

Desmond C. Peyton, National Search Report U.S. Appl. No. 12/368,493 dated May 19, 2016.

(Continued)

*Primary Examiner* — Alfred Basichas
(74) *Attorney, Agent, or Firm* — Michael E. Tschupp; Andre Pallaies; Brandon G. Braun

(57) ABSTRACT

A home cooking appliance includes a cooktop surface and a gas pedestal burner on the cooktop surface. The gas pedestal burner includes a burner portion having a sidewall, a lower surface facing the cooktop surface, a plurality of burner ports in the sidewall, and a base portion under the burner portion. The base portion elevates the burner portion in a vertical direction above the cooktop surface and has a lower mounting surface disposed on the cooktop surface. An area of a footprint of the lower mounting surface of the base portion is less than an area of a footprint of the lower surface of the burner portion.

30 Claims, 35 Drawing Sheets

Related U.S. Application Data continuation-in-part of application No. 12/368,493, filed on Feb. 10, 2009, now Pat. No. 10,655,844.

(56) References Cited

U.S. PATENT DOCUMENTS

| | | | | |
|---|---|---|---|---|
| 4,810,188 | A | 3/1989 | Kwiatek | |
| 4,846,671 | A * | 7/1989 | Kwiatek | F24C 3/085 431/266 |
| 4,891,006 | A | 1/1990 | Le Monnier de Gouville et al. | |
| 5,046,477 | A | 9/1991 | Bennett et al. | |
| 5,080,580 | A | 1/1992 | Clapp | |
| 5,098,283 | A | 3/1992 | Clapp | |
| 5,291,875 | A | 3/1994 | Koziol | |
| 6,067,978 | A | 5/2000 | Schlosser et al. | |
| 6,135,764 | A | 10/2000 | Kwiatek | |
| 6,299,436 | B1 | 10/2001 | Huang | |
| 6,315,552 | B1 | 11/2001 | Haynes et al. | |
| 6,318,993 | B1 | 11/2001 | Huang | |
| 6,322,354 | B1 | 11/2001 | Carbone et al. | |
| 6,328,556 | B1 | 12/2001 | Somer | |
| 6,439,881 | B2 | 8/2002 | Haynes et al. | |
| 6,439,882 | B2 | 8/2002 | Haynes et al. | |
| 6,736,631 | B2 | 5/2004 | Ferlin et al. | |
| 7,291,009 | B2 | 11/2007 | Kamal et al. | |
| 7,322,820 | B2 | 1/2008 | Welton et al. | |
| 7,871,264 | B2 | 1/2011 | Pryor et al. | |
| 8,511,294 | B2 | 8/2013 | Paesani | |
| 2003/0024525 | A1 | 2/2003 | Jennings | |
| 2003/0087214 | A1 | 5/2003 | Welton et al. | |
| 2003/0140918 | A1 | 7/2003 | Taplan | |
| 2003/0170580 | A1* | 9/2003 | Ferlin | F24C 3/085 431/266 |
| 2006/0000467 | A1 | 1/2006 | Hibshman, II et al. | |
| 2006/0051718 | A1 | 3/2006 | Kamal et al. | |
| 2008/0160468 | A1 | 7/2008 | Pryor et al. | |
| 2009/0047611 | A1 | 2/2009 | Armanni | |
| 2009/0100837 | A1 | 4/2009 | Von Der Bank | |
| 2009/0320823 | A1 | 12/2009 | Padgett | |

OTHER PUBLICATIONS

Desmond C. Peyton, National Search Report U.S. Appl. No. 12/368,493 dated Jun. 10, 2013.

Desmond C. Peyton, National Search Report U.S. Appl. No. 12/368,493 dated Aug. 24, 2017.

Desmond C. Peyton, National Search Report U.S. Appl. No. 12/368,493 dated Aug. 31, 2015.

Desmond C. Peyton, National Search Report U.S. Appl. No. 12/368,493 dated Oct. 20, 2016.

* cited by examiner

| Test # | Clearance (mm) | Maintop Temperature (°C) |
|---|---|---|
| 1 | 19 | 344 |
| 2 | 22 | 312 |
| 3 | 25 | 186 |

FIG. 7D

HOME COOKING APPLIANCE HAVING A PEDESTAL BURNER

CROSS-REFERENCE TO RELATED APPLICATION

This application is Continuation application of co-pending U.S. application Ser. No. 15/158,766, filed on May 19, 2016, which is a Continuation-in-part application of co-pending U.S. application Ser. No. 12/368,493, filed on Feb. 10, 2009, for which priority is claimed under 35 U.S.C. § 120, the entire contents of each of the above identified patent applications are hereby incorporated by reference.

FIELD OF THE INVENTION

The present invention relates to a home appliance, and more particularly, to a home cooking appliance having a gas pedestal burner.

BACKGROUND OF THE INVENTION

In conventional cooking appliances, one or more gas burners are disposed on a cooktop surface of the cooking appliance. For example, FIG. 1 shows a conventional home cooking appliance 10 having a housing 12 and a cooktop surface 14. The cooktop surface 14 includes a plurality of burners 20. The housing 12 supports a grate 26 to support a cooking utensil, such as a pot, pan or kettle over the burner 20. The cooktop surface 14 has a plurality of openings (not shown) defining the positions for each of the burners 20. The cooktop surface 14 shown in FIG. 1 has a sealed burner arrangement.

Although burners for controlling gas flow and flame generation in a cooking appliance have been known, a recent development improves flame spreading features within a controlled area so that the burner does not create a limited set of rings of heat application to a cooking utensil. For example, U.S. application Ser. No. 08/955,002 discloses a multiple fingered burner that expands the heating zone without exposing the peripheral ports in the fingers to exposure from spills occurring above the cooktop. The multiple fingered burner increases or maximizes a perimeter of the burner while also providing more consistent heating of a cooking utensil across the heating zone. That is, the multiple fingered burner expands the heating zone to be more consistent over the perimeter and central zones of the cooking utensil.

While such an arrangement improves distribution of the flames within a cooktop area, recent developments have attempted to further improve access to primary and secondary air in order to maintain appropriately sized flame kernels throughout the irregular pattern of flame kernels throughout the cooktop area, and particularly when a sealed burner arrangement is provided.

Additionally, recent cooktop innovations have attempted to maintain a low profile burner so as not to expose a protruding, interfering surface above the cooktop surface of the appliance. However, the lowering of the burner in the cooktop also may interfere with the free flow of secondary air near the burner ports that receive and discharge a primary fuel and air mixture. In addition, the conventional cooktop designs that provide sealed burner openings may restrict access to secondary air within the appliance and prevent the use of this air as secondary bypass air near the burner ports.

Some conventional appliances attempt to improve access to secondary air for flame production while also minimizing the height of the burner with respect to the cooktop surface. Referring to FIGS. 2A-2D, in some conventional appliances, the cooktop surface 14 includes a "volcano-type" pedestal 30 that is integrally formed with the cooktop surface 14 to elevate the burner 20 above the cooktop surface 14. The burner 20 may be a circular or oval burner, a multiple fingered burner, or other burner. This arrangement may improve access to secondary air for flame production. The integral "volcano-type" pedestal 30 commonly is stamped or formed in the material of the cooktop surface 14 of the appliance. The "volcano-type" pedestal 30 commonly mimics the shape of the burner 20 to provide support for the burner 20. Also, the size of the "volcano-type" pedestal 30 commonly is greater than or equal to the size of the burner 20.

In other conventional systems, the burner may include a pedestal, either separate or integral, to elevate the burner above the cooktop surface. Conventionally, the pedestal has a shape that corresponds to, or mimics, the shape of the burner. Also, the size of the pedestal is greater than or equal to the size of the burner to provide support for all areas of the burner.

SUMMARY OF THE INVENTION

An exemplary embodiment of the invention is directed to a home cooking appliance including a cooktop surface, a gas pedestal burner on the cooktop surface, wherein the gas pedestal burner includes a burner portion having a sidewall, a lower surface facing the cooktop surface, and a plurality of burner ports in the sidewall, and a base portion under the burner portion, the base portion elevating the burner portion in a vertical direction above the cooktop surface, wherein the base portion has a lower mounting surface disposed on the cooktop surface, and wherein an area of a footprint of the lower mounting surface of the base portion is less than an area of a footprint of the lower surface of the burner portion.

These features are important for, among other things, providing a home cooking appliance having a low profile burner that (1) elevates a burner portion of the burner in a vertical direction above the cooktop surface, (2) reduces or minimizes an interface between the burner and the cooktop (i.e., drip pan) without affecting the size or shape of the burner portion of the burner, which decreases the susceptibility of the appliance to trapping or capturing food or spills around the burner, thereby improving the cleanability of the appliance, (3) provides separation between the surface of the cooktop (i.e., drip pan) and the burners to minimize or prevent burning of spills (e.g., a liquid or solid) onto the surface of the cooktop, thereby further improving the cleanability of the appliance, and (4) improves air flow to the burners from below the burners, as well as from the sides of the burners, thereby improving flame production and increasing the performance of the burner.

Other features and advantages of the present invention will be described below. To provide a better understanding of the invention, and for further clarification and background of the present invention, various aspects and considerations of a home cooking appliance, which have been recognized by the present invention, first will be explained in greater detail.

The present invention recognizes that there is a need to provide an appliance having a burner that improves access to secondary air for flame production while also minimizing the height of the burner with respect to the cooktop surface to provide a low-profile design and at the same time improving the ease with which a user can access and clean surfaces on and around the burner.

As explained above, conventional "volcano-type" pedestals may be integrally formed with the cooktop surface to elevate the burner above the cooktop surface to improve access to secondary air for flame production. However, these conventional pedestals also increase the footprint of the pedestal and burner. As shown in FIGS. 2A-2D, the increased size of the footprint of the "volcano-type" pedestal 30 results in an increase in the length of the interface 32 between the cooktop surface 14 and the "volcano-type" pedestal 30. This interface 32 may increase the susceptibility of the appliance to trapping or capturing food or spills and also may increase the time and difficulty of cleaning around the burner 20, and more particularly, cleaning the interface 32 between the "volcano-type" pedestal 30 and the cooktop surface 14. The length of the interface 34 between the burner 20 and the "volcano-type" pedestal 30 also may increase the time and difficulty of cleaning around the burner 20, and more particularly, cleaning the interface 34 between the burner 20 and the "volcano-type" pedestal 30.

Furthermore, the conventional pedestals commonly result in a surface of the cooktop being disposed adjacent to or substantially close to the burners, as shown in FIG. 2D. As a result, in many conventional appliances, a flame 50 from the burner 20 may be close enough to the surface of the cooktop 14 to heat or bake a spill (e.g., liquid or solid) onto the surface of the cooktop, and more particularly, at the interfaces 32 and 34, thereby rendering cleaning of the cooktop more difficult.

Also, in many conventional appliances, a flame from the burner may be close enough to the surface of the cooktop to cause discoloration of the surface of the cooktop, for example, over a period of time and use. The discoloration of the surface may result in an undesirable appearance to a user.

Additionally, in many conventional appliances, the burner is located close to the surface of the pedestal such that the flow of secondary air for contributing to flame production may be inhibited or restricted. For example, as shown in FIG. 2C, the adjacent surfaces of the pedestal 30 and the burner 20 may result in a flow of the secondary air 70 making a sharp bend or turn, which may restrict or choke the supply of secondary air 70 to the flame 50. As shown in FIG. 3, the choking effect may be increased because of an arrangement of a sealed burner, which may limit access to secondary air from other sources, such as within the appliance or under the cooktop surface 14. FIG. 4 shows a non-sealed burner that can draw secondary air 60 from within the appliance or under the cooktop via the opening 40 in the cooktop surface 14. However, the non-sealed burner may restrict or choke the flow of secondary air 70 from above the cooktop surface, which may affect the flame production.

To solve the problems with the conventional appliances, the present invention provides a home appliance, and more particularly, a home cooking appliance having a gas pedestal burner including a burner portion having a sidewall, a lower surface facing the cooktop surface, and a plurality of burner ports in the burner portion, and a base portion under the burner portion, the base portion elevating the burner portion in a vertical direction above the cooktop surface, wherein the base portion has a lower mounting surface disposed on the cooktop surface. An area of a footprint of the lower mounting surface of the base portion can be less than an area of a footprint of the lower surface of the burner portion. An outermost perimeter edge of the burner portion can extend radially outward in a horizontal direction by a greater amount than an outermost perimeter edge of the base portion.

As set forth above, these features are important for, among other things, providing a home cooking appliance having a low profile burner that (1) elevates a burner portion of the burner in a vertical direction above the cooktop surface, (2) reduces or minimizes an interface between the burner and the cooktop (i.e., drip pan) without affecting the size or shape of the burner portion of the burner, which decreases the susceptibility of the appliance to trapping or capturing food or spills around the burner, thereby improving the cleanability of the appliance, (3) provides separation between the surface of the cooktop (i.e., drip pan) and the burners to minimize or prevent burning of spills (e.g., a liquid or solid) onto the surface of the cooktop, thereby further improving the cleanability of the appliance, and (4) improves air flow to the burners from below the burners, as well as from the sides of the burners, thereby improving flame production and increasing the performance of the burner.

The present invention improves the cleanability of the appliance, and hence, the long term appearance of the appliance. Aspects of the present invention can minimize or reduce a footprint of the burner base, thereby further improving the cleanability of the appliance. More particularly, aspects of the invention can decrease the length of the interface between the burner base and the cooktop surface or an intervening part, such as a separate burner base, which may decrease the susceptibility of the appliance to trapping or capturing food or spills. By limiting or reducing the length of these interfaces, the aspects of the invention also may decrease the time and difficulty of cleaning around the burner, and more particularly, decrease the time and difficulty of cleaning these interfaces.

Moreover, aspects of the invention improve access and clearance for cleaning around the burner by raising the burner portion in a vertical direction above the cooktop surface by a sufficient amount to provide clearance for cleaning, while at the same time decoupling (i.e., eliminating the interrelationship between) the size and shape of the footprint of the lower mounting surface of the base portion from the size and shape of the footprint of the lower surface of the burner portion. The present application has recognized that, if the clearance between the underside of the burner portion of the burner pedestal and the cooktop surface is too small, a typical user will not be able to fit their fingers along with a cleaning cloth or fabric in the space between the underside of the burner portion of the burner pedestal, and thus, will not be able to easily clean around the base portion of the burner pedestal or to easily clean the intersection between the base portion of the burner pedestal and the cooktop surface or an intervening part. The present invention has determined that a minimum clearance of approximately 19 mm between the underside of the burner portion of the burner pedestal and the cooktop surface provides sufficient clearance to allow access for common finger sizes along with a cleaning cloth or fabric into the space between the underside of the burner portion of the burner pedestal and the cooktop surface to clean around the base portion of the burner pedestal, or to clean the intersection between the base portion of the burner pedestal and the cooktop surface or an intervening part. The minimum clearance of 19 mm can be provided between the underside of the burner portion of the burner pedestal and the cooktop surface when measured at or near the perimeter of the burner portion. However, in other embodiments, the minimum clearance of 19 mm can be provided between the underside of the burner portion of the burner pedestal and the cooktop surface when measured at or near the intersection of the base portion of the pedestal burner with the burner portion of the pedestal burner, thereby providing sufficient clearance to allow access for common finger sizes along with a cleaning cloth or fabric into the space all the way to the base portion and the intersection between the base portion of the burner pedestal and the cooktop surface or an intervening part.

Furthermore, aspects of the invention can reduce or prevent discoloration of the surface of the cooktop caused by the flame, for example, over a period of time and use, thereby improving a user's satisfaction with the appearance of the appliance. The present invention recognizes that 304 stainless steel discolors at 200° C. The present invention has determined that a minimum clearance of approximately 25 mm between the cooktop surface and an upper surface of the sidewall of the burner portion (e.g., where the flame kernel emerges from the burner ports) results in a measured cooktop surface temperature that is less than 200° C., thereby effectively minimizing or preventing discoloration of a cooktop surface formed from 304 stainless steel.

Aspects of the invention can raise the burner portion in a vertical direction above the cooktop surface by an amount that may be sufficient to reduce or prevent the flame from heating or baking a spill (e.g., a liquid or solid) onto the surface of the cooktop, thereby improving the ease with which the cooktop can be cleaned. That is, the aspects of the invention can reduce or minimize the radiative energy transferred to the cooktop from the flame of the burner. The invention provides an important advantage of reducing or minimizing the temperature of the surfaces of the appliance that are adjacent to the burner during operation of the burner.

The aspects of the invention also provide an important advantage of increasing a horizontal distance from the flame of the burner to the interface between the burner base and the cooktop surface or an intervening part (such as a separate burner base on the cooktop surface), thereby further reducing or preventing the flame from the burner from heating or baking a spill (e.g., a liquid or solid) onto the cooktop surface, and improving the ease with which the cooktop may be cleaned.

Moreover, by raising the burner portion in a vertical direction above the cooktop surface, the aspects of the invention can improve or increase the flow of secondary air for contributing to flame production, thereby improving or increasing the performance of the burner. For example, a gas burner having a pedestal burner according to an aspect of the invention can reduce or prevent a restriction or choking of the flow of secondary air to the flame kernel. Accordingly, the aspects of the invention can maintain appropriately sized flame kernels throughout the irregular pattern (e.g., star-shaped pattern) of flame kernels throughout the cooktop area, and particularly when a sealed burner arrangement is provided. The aspects of the invention also may provide an appearance that the flames are floating above the surface of the cooktop, which may be visually pleasing to the user. The present invention has determined that a minimum clearance of approximately 25 mm between the cooktop surface and an upper surface of the sidewall of the burner portion (e.g., where the flame kernel emerges from the burner ports) can improve or increase the flow of secondary air for contributing to flame production, thereby improving or increasing the performance of the burner.

As explained above, the home cooking appliance can include one or more burners in which the burner portion is elevated by a predetermined vertical distance above the cooktop surface. The burner can include a burner portion, which includes a plurality of burner ports, and a base portion under the burner portion that supports the burner portion and elevates the burner portion in a vertical direction above the cooktop surface. In an exemplary embodiment, the burner portion and the base portion can be integrally formed. In other exemplary embodiments, the burner portion and the base portion can be formed and assembled from separate parts.

The present invention also provides an important advantage of reducing costs, such as manufacturing costs associated with the appliance. For example, an aspect of the present invention may take the place of the "volcano-type" pedestal such that the cooktop surface may be provided with a flat surface, while still providing a desired elevation of the burner portion above the cooktop surface and/or a desired clearance between the burner portion and the cooktop surface. These aspects may reduce the complexity and costs associated with manufacturing the cooktop surface, since the "volcano-type" pedestal may not be formed in the cooktop surface.

Furthermore, the cooktop surface can be formed from a variety of materials that otherwise may not be suitable for the "volcano-style" pedestal or for which forming a "volcano-style" pedestal may be difficult or costly. For example, one of ordinary skill in the art will recognize that forming a glass cooktop surface with an integrally formed pedestal may be more difficult and costly as compared to forming a similar pedestal in a steel cooktop. The aspects of the present invention provide important advantages in that the cooktop surface can be formed from a variety of materials, such as a glass surface, a steel surface, a stainless steel surface, a porcelain surface, a painted surface, or another suitable surface. In these aspects of the invention, the pedestal burner may be mounted directly on the cooktop surface.

In other aspects, the pedestal burner may be provided in combination with a "volcano-style" pedestal on the cooktop surface. The pedestal burner may provide important advantages such as reducing the size of the "volcano-style" pedestal, which may reduce the complexity and costs associated with producing the "volcano-style" volcano pedestal on the cooktop. In some aspects, a more compact and low-profile pedestal burner also may be provided since the clearance between the lower surface of the burner portion of the pedestal burner and the cooktop surface with be the sum of the height of the "volcano-style" pedestal and the height of the base portion of the pedestal burner. Other aspects of the home cooking appliance can include a pedestal burner having a lower mounting surface mounted on or coupled to one or more intervening parts, which in turn are mounted on or above the cooktop surface. For example, a separate burner base can be provided on the cooktop surface or on a "volcano-style" pedestal on the cooktop surface, and the separate burner base can support the lower mounting surface of the pedestal burner. In other aspects, the home cooking appliance can include a combination of a "volcano-style" pedestal and a pedestal burner that cooperate to elevate a burner portion of the pedestal burner by a predetermined vertical distance above the cooktop surface, or a combination of a "volcano-style" pedestal, an intervening part (such as a separate burner base), and a pedestal burner that cooperate to elevate a burner portion of the pedestal burner by a predetermined vertical distance above the cooktop surface. In each exemplary aspect, the present invention can be configured to provide a vertical clearance (e.g., a predetermined minimum vertical clearance) between a lower surface of the burner portion of the pedestal burner and the cooktop surface, thereby making it easier for a user to access and clean the surface of the cooktop under the burner portion, and particularly, easier for a user to access and clean an interface between the base portion of the pedestal burner and the cooktop surface, the "volcano-style" pedestal, or the intervening part, while at the same time providing a low-profile burner.

In these exemplary aspects, a height of the base portion can be minimized to provide a low profile burner on the cooktop surface that provides sufficient clearance for cleaning while at the same time decoupling (i.e., eliminating the interrelationship between) the size and shape of the footprint of the lower mounting surface of the base portion from the size and shape of the footprint of the lower surface of the burner portion. For example, the present application has recognized that, if the clearance is too small, a typical user will not be able to fit their fingers along with a cleaning cloth or fabric in the space between the underside of the burner portion of the burner pedestal and the cooktop surface to clean around the base portion of the burner pedestal, or to clean the intersection between the base portion of the burner pedestal and the "volcano-style" pedestal of the cooktop surface. Similarly, in embodiments with an intervening part between the base portion of the burner pedestal and the cooktop, or between the base portion of the burner pedestal and the "volcano-style" pedestal, a typical user will not be able to fit their fingers along with a cleaning cloth or fabric in the space to clean. The present invention has determined that a minimum clearance of approximately 19 mm, provided by the combination of the burner pedestal and the "volcano-style" pedestal and/or an intervening part, provides sufficient clearance to allow access for common finger sizes along with a cleaning cloth or fabric into the space between the underside of the burner portion of the burner pedestal and the cooktop surface to clean around the base portion of the burner pedestal, or to clean the intersection between the base portion of the burner pedestal and the "volcano-style" pedestal of the cooktop surface, the cooktop surface, or an intervening part. The minimum clearance of 19 mm can be provided between the underside of the burner portion of the burner pedestal and the cooktop surface when measured at or near the perimeter of the burner portion. However, in other embodiments, the minimum clearance of 19 mm can be provided between the underside of the burner portion of the burner pedestal and the cooktop surface when measured at or near the intersection of the base portion of the pedestal burner with the burner portion of the pedestal burner, thereby providing sufficient clearance to allow access for common finger sizes along with a cleaning cloth or fabric into the space all the way to the base portion and the intersection between the base portion of the burner pedestal and the cooktop surface or an intervening part. As a result, the exemplary embodiments of the present invention can minimize a height of the base portion to provide a low profile burner on the cooktop surface that, in cooperation with a "volcano-style" pedestal and/or an intervening part, provides sufficient clearance for cleaning while at the same time decoupling (i.e., eliminating the interrelationship between) the size and shape of the footprint of the lower mounting surface of the base portion from the size and shape of the footprint of the lower surface of the burner portion.

Other aspects of the invention can improve or increase the flow of secondary air from within the appliance or under the cooktop, which may improve the flame production. More particularly, an aspect provides an internal path for the flow of secondary air from within the appliance or under the cooktop. Accordingly, aspects of the present invention can provide the advantages of both a sealed burner and a non-sealed burner. The present invention also can minimize or eliminate the disadvantages of the conventional sealed burner and/or non-sealed burner. The present invention can be configured as a sealed burner or a non-sealed burner.

The features of the invention, however, together with additional aspects, objects and advantages thereof will be best understood from the following description of exemplary aspects when read in connection with the accompanying drawings.

BRIEF DESCRIPTION OF THE DRAWINGS

These and other aspects and features of embodiments of the present invention will be better understood after a reading of the following detailed description, together with the attached drawings, wherein:

FIG. 7D is a table illustrating test results of the measured temperature of a cooktop surface of a home cooking appliance according to several exemplary embodiments of the invention;

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to FIGS. 5-23, exemplary embodiments of the invention will now be described.

Figure 1:
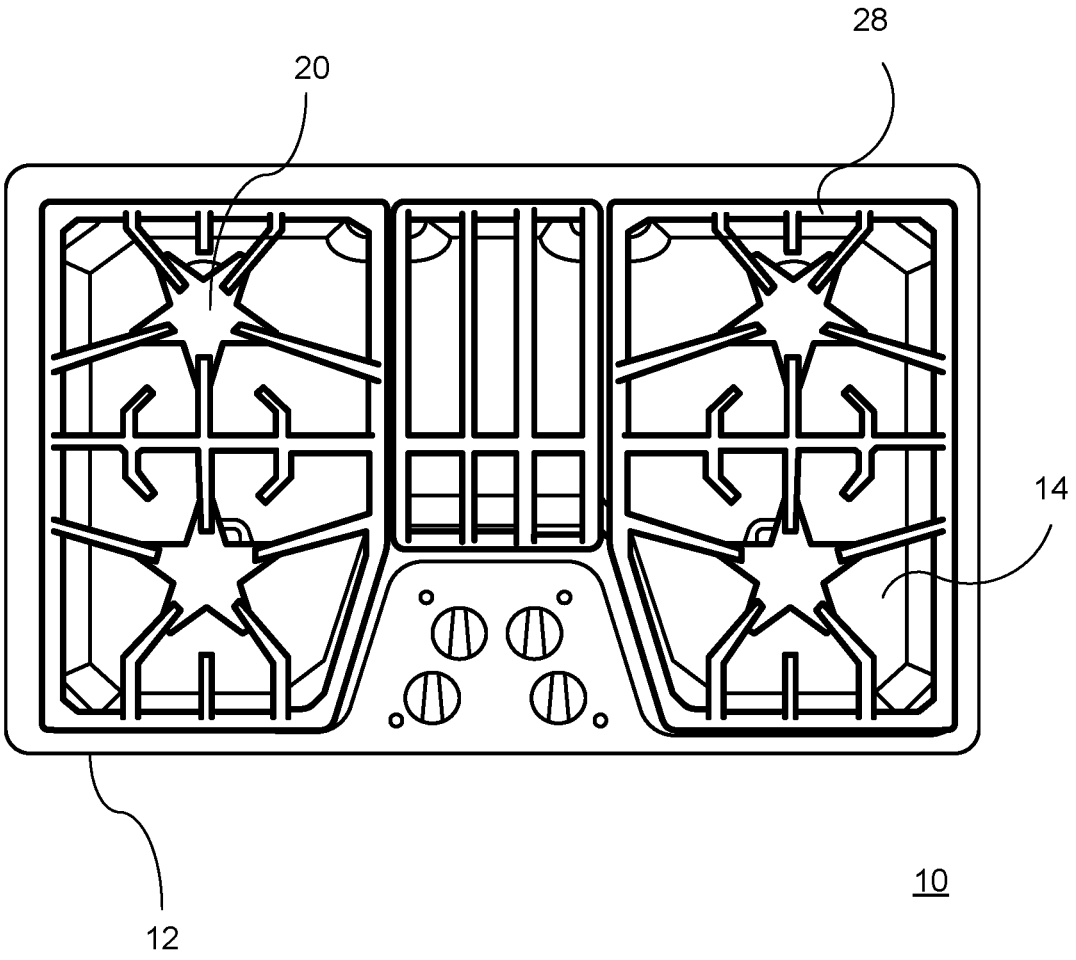
FIG. 1 CONVENTIONAL ART
FIG. 1 is a top view of a conventional cooking appliance.
Figure 2A:
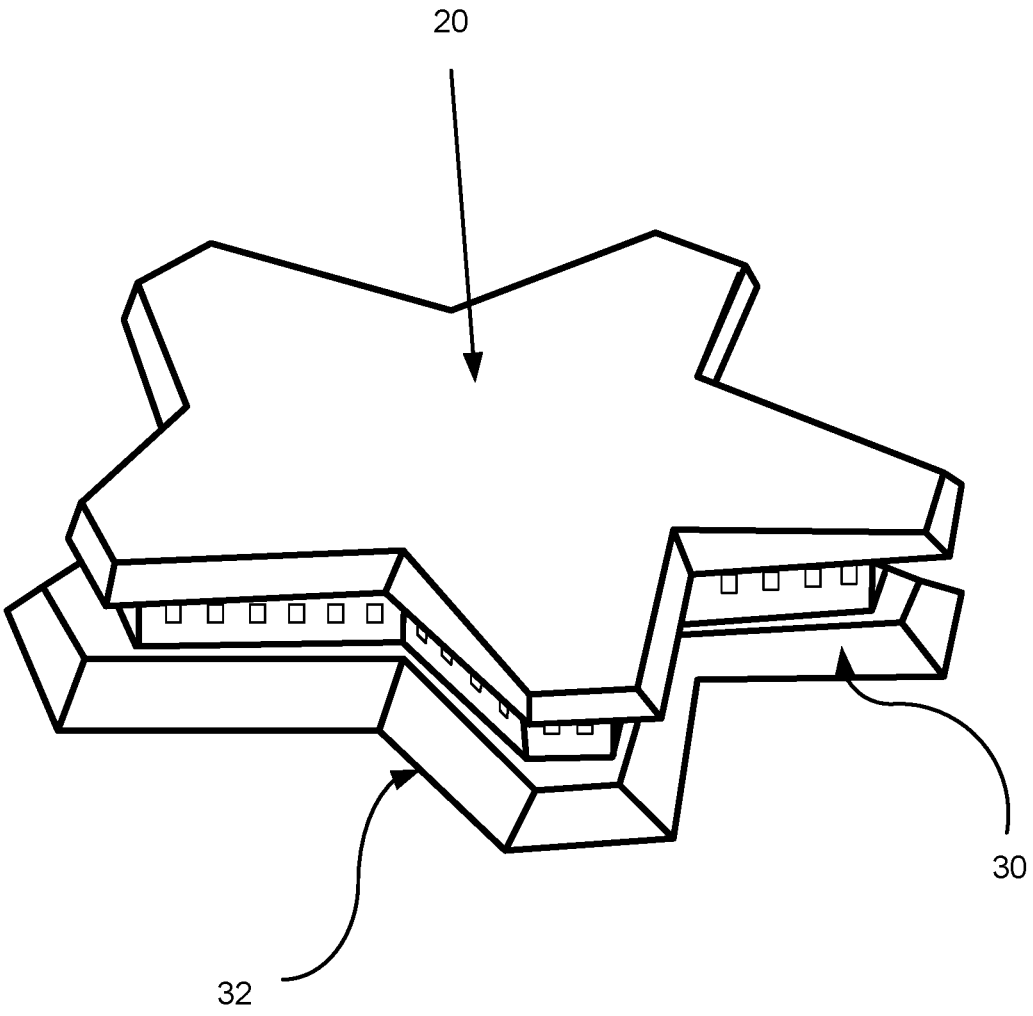
FIG. 2A CONVENTIONAL ART
FIG. 2A is a perspective view of a conventional burner assembly.
Figure 2B:
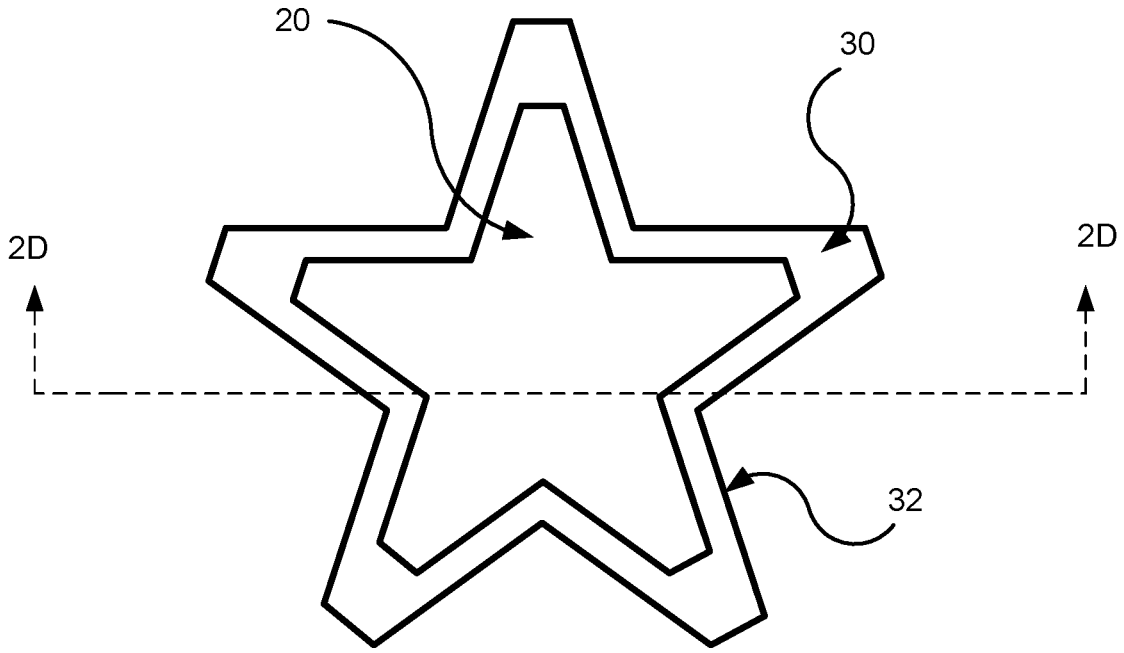
FIG. 2B CONVENTIONAL ART
FIG. 2B is a top view of the conventional burner assembly of FIG. 2A.
Figure 2C:
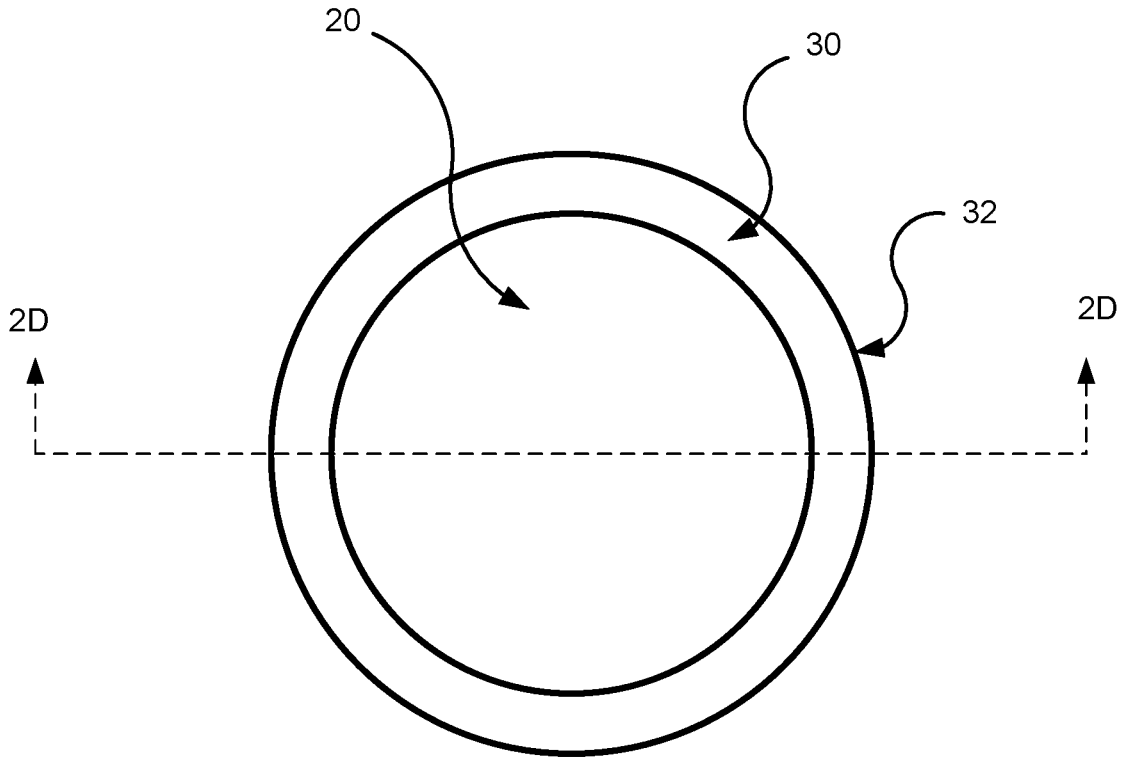
FIG. 2C CONVENTIONAL ART
FIG. 2C is a top view of another conventional burner assembly.
Figure 2D:
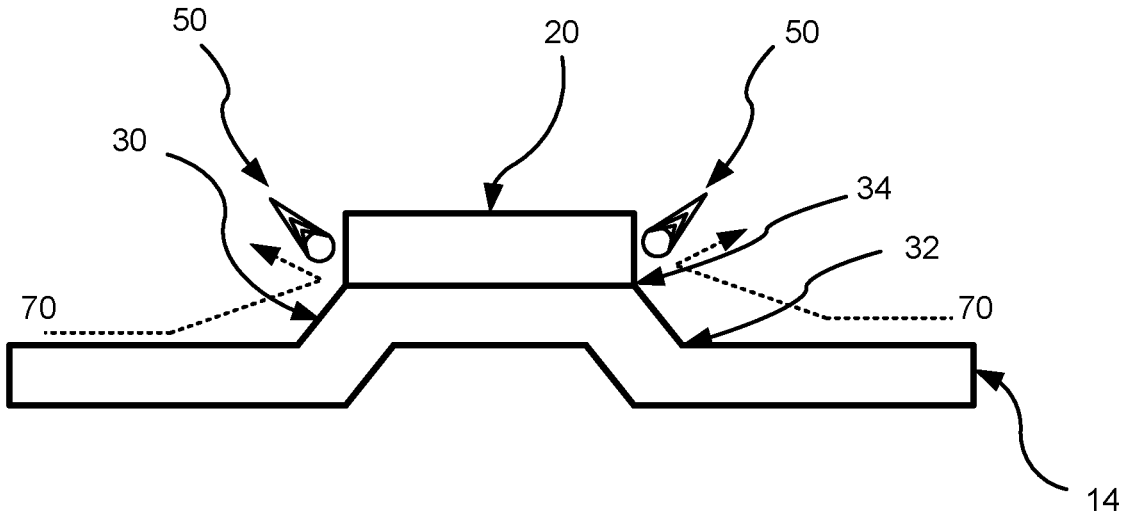
FIG. 2D CONVENTIONAL ART
FIG. 2D is a cross-sectional view of the conventional sealed burner assemblies of FIGS. 2B and 2C.
Figure 3:
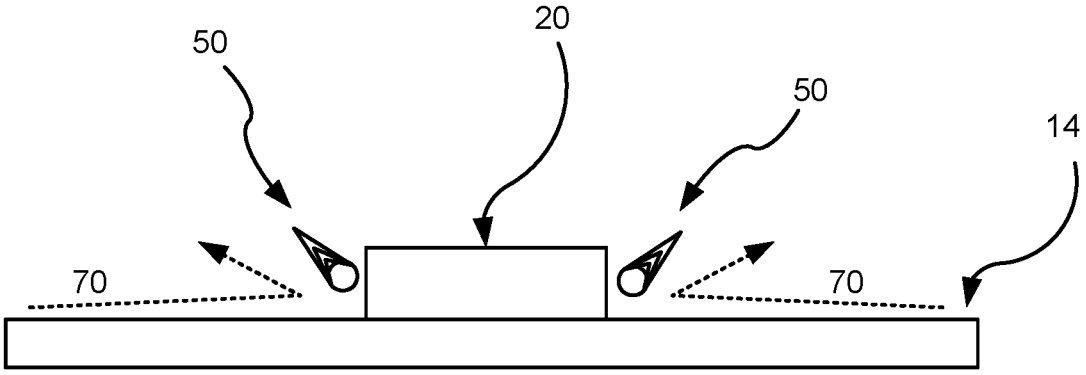
FIG. 3 CONVENTIONAL ART
FIG. 3 is a partial cross-sectional view of a conventional home cooking appliance having a sealed burner.
Figure 4:
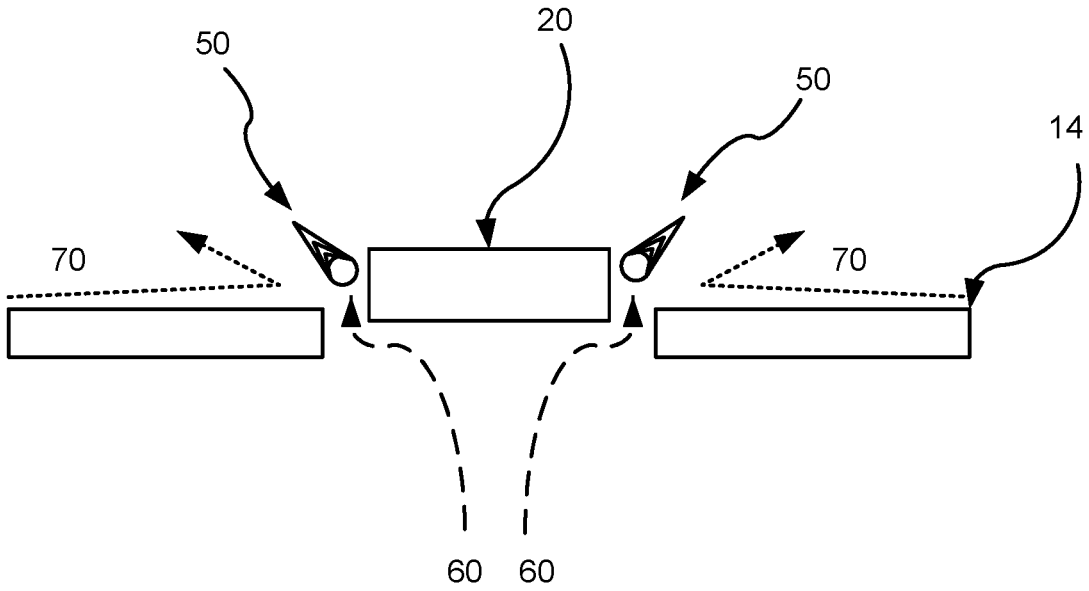
FIG. 4 CONVENTIONAL ART
FIG. 4 is a partial cross-sectional view of a conventional home cooking appliance having a non-sealed burner.
Figure 5:
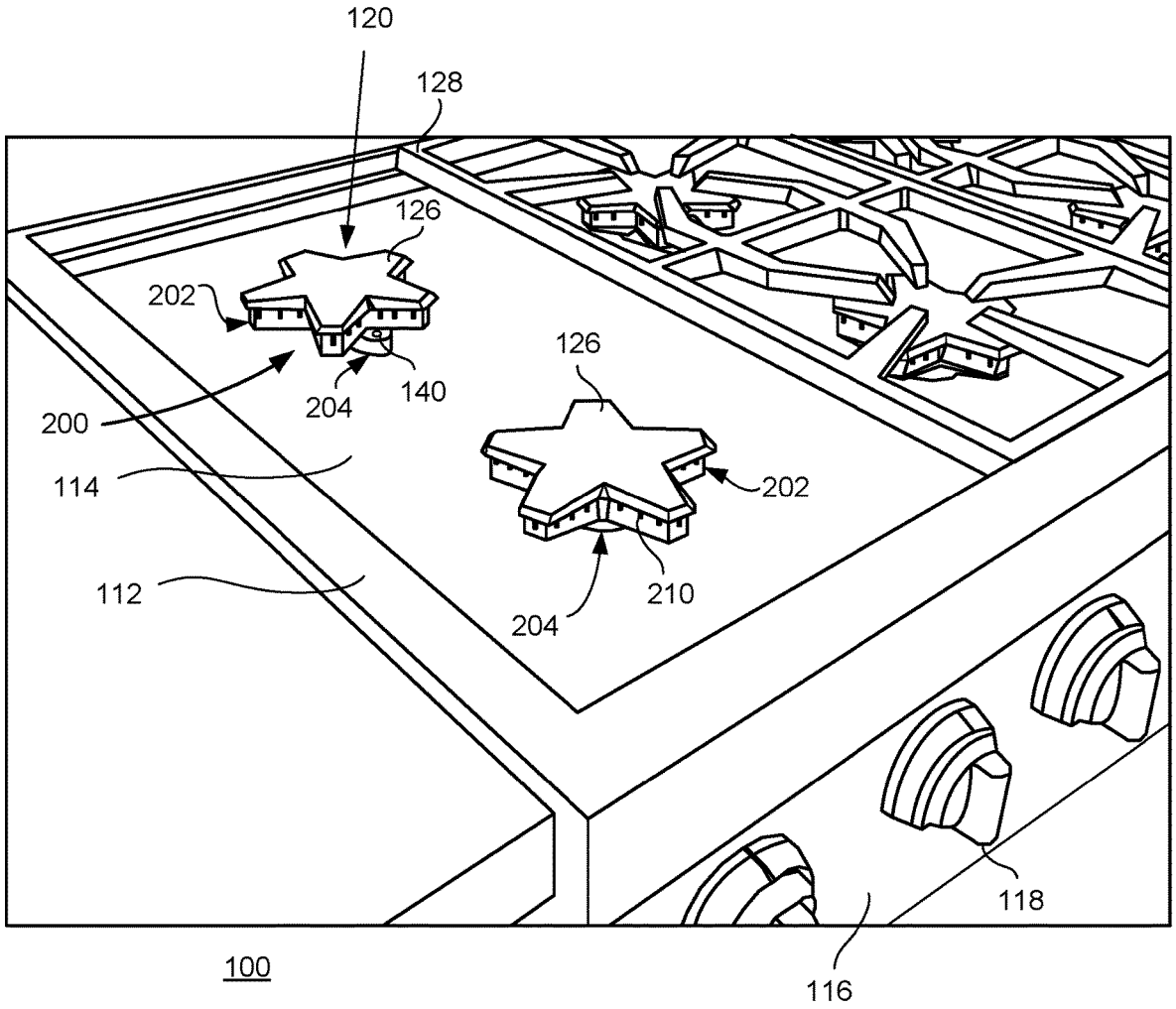
FIG. 5 is a perspective view illustrating a home cooking appliance according to an embodiment of the invention.

Referring to FIG. 5, a home cooking appliance 100 is shown having a housing 112 and a cooktop surface 114. The cooktop surface 114 includes a plurality of burners 120. The housing 112 supports a grate 128 to support a cooking utensil, such as a pot, pan or kettle over the burner 120. The cooktop surface 114 has a plurality of openings (not shown in FIG. 5) defining the positions for each of the burners 120. In an exemplary aspect, the cooktop surface 114 forms a sealed burner arrangement which is discussed in greater detail below.

Each burner 120 includes a burner body 200 and a burner cap 126 that covers the burner body 200 to prevent leakage or overspills from cooking utensils from entering the burner 120. The burner body 200 in this aspect has a plurality of fingers that form a star configuration and the burner cap 126 has a corresponding star configuration. However, the burner body 200 and burner cap 126 may have other configurations and shapes, such as a circular or oval shape, or another number of fingers. In an exemplary embodiment, the burner body 200 of each burner 120 has an upper portion or burner portion 202, which includes a plurality of burner ports 210, and a base portion 204 that elevates the burner portion 202 in a vertical direction above the cooktop surface 114. The burner portion 202 (upper portion) and the base portion 204 (lower portion) can be integrally formed or separate parts, as shown for example in the exemplary embodiments illustrated in FIGS. 6-16. In other exemplary embodiments, the burner body 200 of each burner 120 has a burner portion 350, which includes a plurality of burner ports 424, and a separately formed pedestal portion 400 that elevates the burner portion 350 in a vertical direction above the cooktop surface 114, as shown for example in the exemplary embodiments illustrated in FIGS. 17-23. Each of these exemplary embodiments will be described in greater detail below.

With reference again to FIG. 5, an ignitor 140 is provided for igniting the air-gas mixture flowing from the burner ports 210 of the burner 120. The burner ports 210 can be formed in a sidewall of the burner portion, in an upper surface of the sidewall of the burner portion, and/or in an upper surface, cover, or cap of the burner portion. In the illustrated example, the ignitor 140 can be configured to be mounted on a surface of the base portion 204 (or a surface of a separately formed pedestal portion 400). A plurality of control knobs 118 are carried on valve stems (not shown) protruding through openings in the control panel 116, as shown in FIG. 5, or alternatively, in the cooktop surface 114. The control knobs 118 are used to control a valve for flow of gas and the ignition of each of the burners 120 in a well-known manner. The openings in the control panel 116 can be configured to contribute to the availability of secondary air within the appliance since the openings are not positioned where leakage or overspills from cooking utensils will expose the burner 120 or the ignitor to clogs or blockages that may interfere with operation of the burners 120. In another embodiment, the cooking appliance 100 may have an electronic, electromechanical, or mechanical control valve in place of the control knobs 118.

Figure 6:
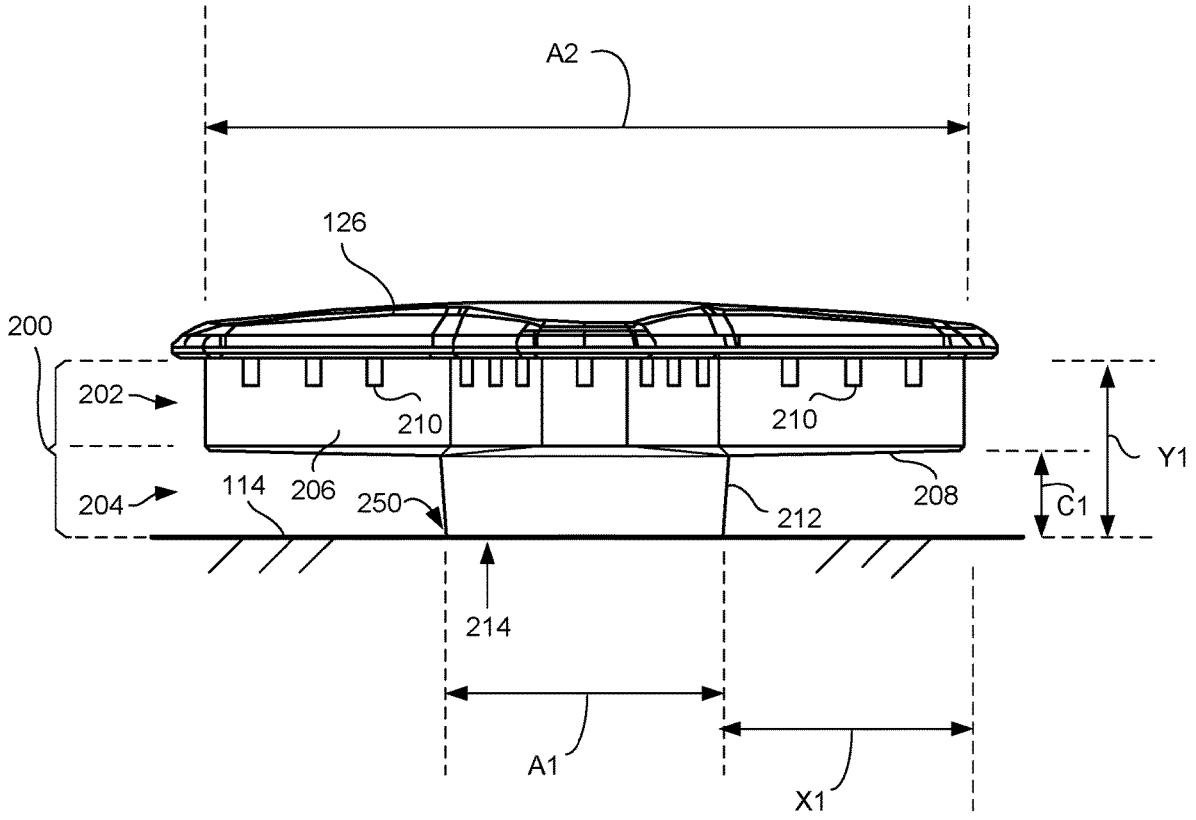
FIG. 6 is a side view of a plurality-fingered burner assembly of a home cooking appliance having a planar cooktop surface according to an embodiment of the invention.

Referring to FIGS. 5 and 6, each burner 120 includes a burner body 200 and a burner cap 126 that covers the burner body 200 to prevent leakage or overspills from cooking utensils from entering the burner body 200. The burner body 200 and burner cap 126 define an interior chamber or cavity. The burner body 200 includes a plurality of recesses forming burner ports 210. The burner ports 210 are in fluid communication with the interior chamber or cavity and the exterior of the burner 120 for permitting flow of the air-gas mixture from the burner 120. The burner ports 210 can be formed in a sidewall of the burner portion, in an upper surface of the sidewall of the burner portion, and/or in an upper surface, cover, or cap of the burner portion.

As shown in FIG. 5, the burner body 200 in this example has a plurality of fingers that form a star configuration and the burner cap 126 has a corresponding star configuration. In this aspect, the burner body 200 has five fingers that form a star configuration. One of ordinary skill in the art will recognize that other numbers of fingers and configurations can be provided. For example, the burner body 200 and burner cap 126 may have other configurations and shapes, such as a different number of fingers than shown in the example embodiments, a circular shape, an oval shape, an irregular shape, etc. A size, shape, arrangement, etc. of the burner cap 126 can be configured to closely correspond to the size, shape, arrangement, etc. of the burner body 200, or the burner cap 126 may differ from the burner body 200 in one or more ways.

Referring to FIGS. 5 and 6, one or more of the burners 120 can be configured to elevate the burner portion by a predetermined vertical distance above the cooktop surface 114. As shown in the example illustrated in FIG. 6, the burner body 200 of each burner 120 has a burner portion 202, which includes a plurality of burner ports 210, and a base portion 204 under the burner portion 202 that supports the burner portion 202 and elevates the burner portion 202 in a vertical direction above the cooktop surface 114. The burner portion 202 and the base portion 204 can be integrally formed, as shown for example in the exemplary embodiments illustrated in FIGS. 6-16, or separate parts, as shown for example in the exemplary embodiments illustrated in FIGS. 17-23.

Referring to FIG. 6, the burner portion 202 has a sidewall 206 having a plurality of burner ports 210 and a lower surface 208 facing the cooktop surface 114. The burner cap 126 can be supported on top of the burner portion 202. The locations of the burner ports 210 are not limited to the illustrated embodiment and can be formed in one or more of the sidewall of the burner portion, in an upper surface of the sidewall of the burner portion, and/or in an upper surface, cover, or cap of the burner portion.

Figure 7A:
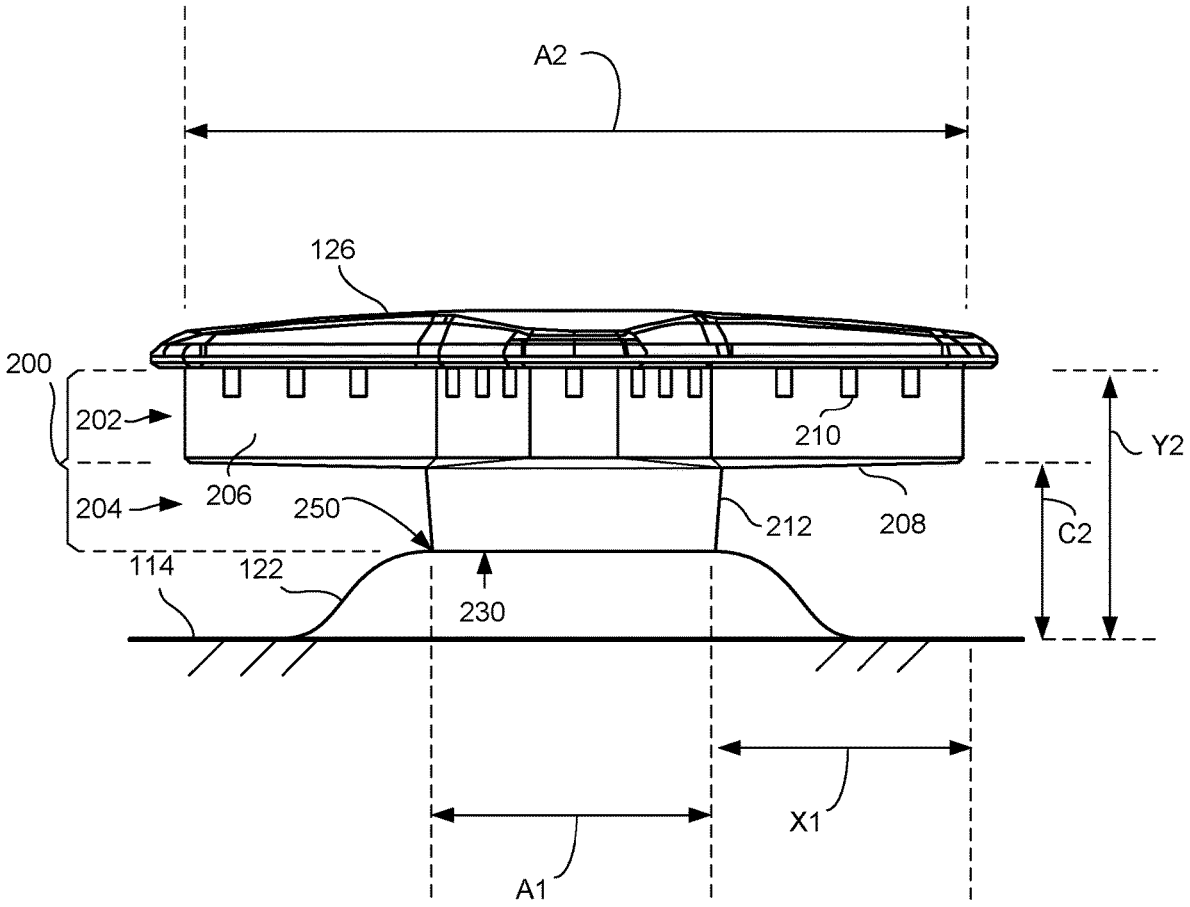
FIG. 7A is a side view of a plurality-fingered burner assembly of a home cooking appliance having a volcano-style cooktop surface according to another embodiment of the invention.
Figure 7B:
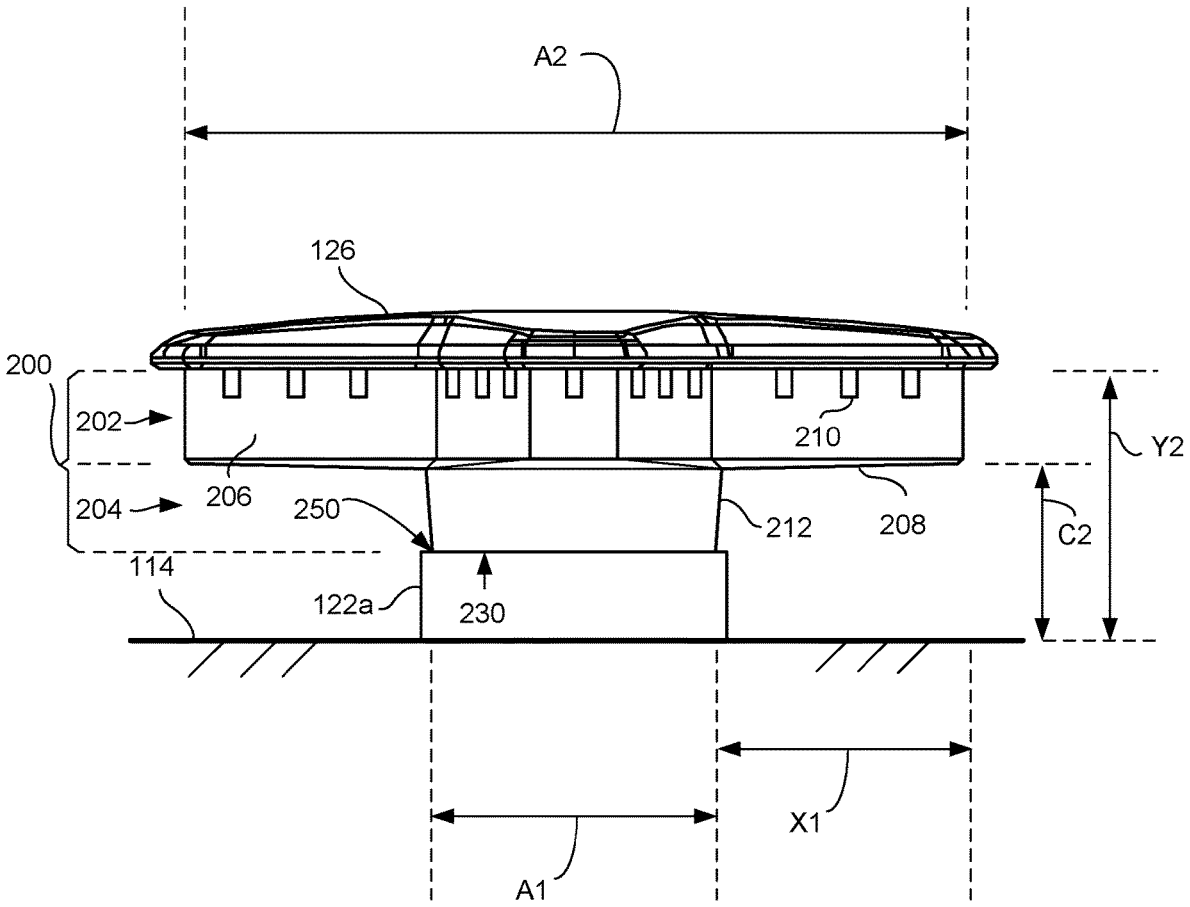
FIG. 7B is a side view of a plurality-fingered burner assembly of a home cooking appliance according to another embodiment of the invention.
Figure 7C:
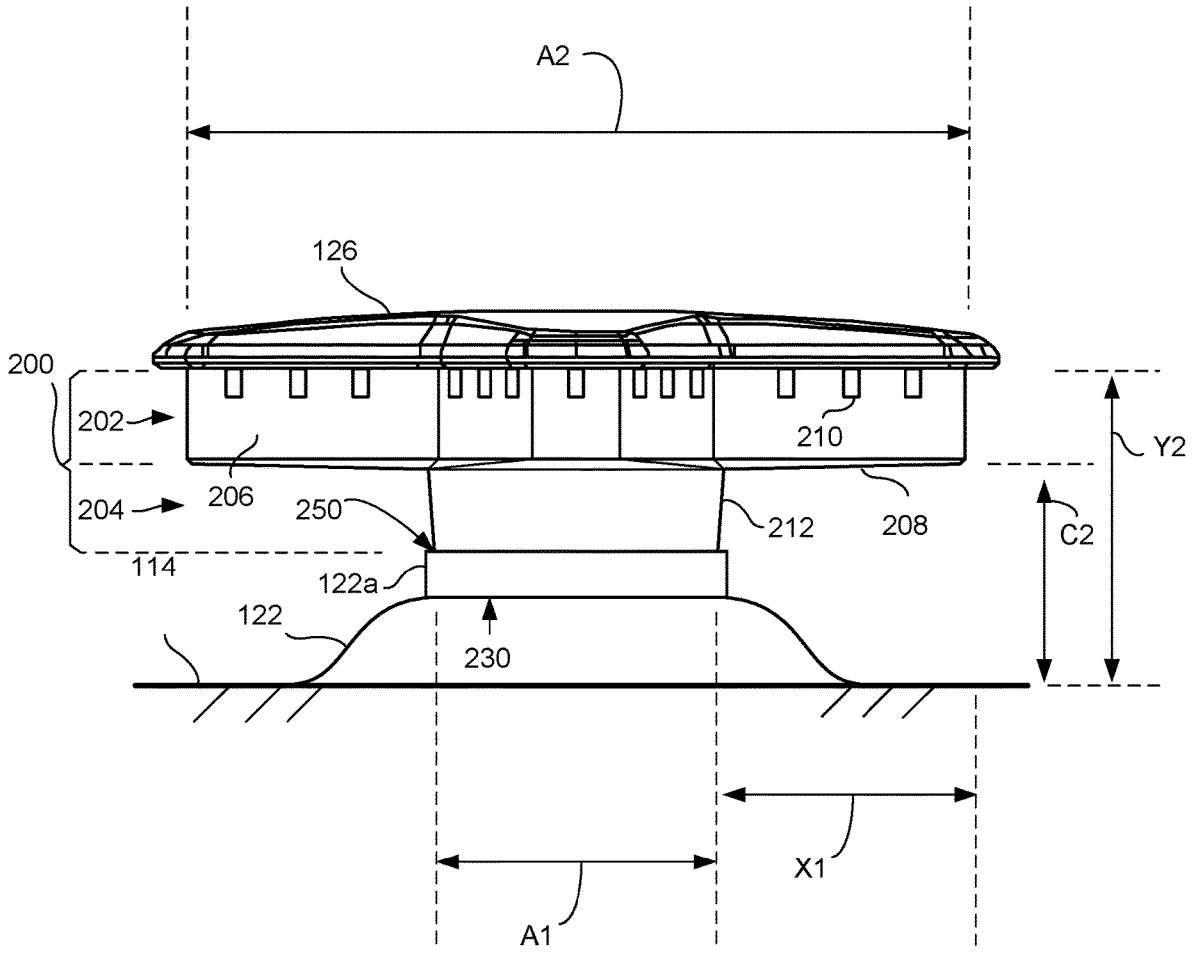
FIG. 7C is a side view of a plurality-fingered burner assembly of a home cooking appliance according to another embodiment of the invention.

The burner body 200 includes a base portion 204 under the burner portion 202 that elevates the burner portion 202 in a vertical direction above the cooktop surface 114. The base portion 204 has a sidewall 212 that intersects with the lower surface 208 of the burner portion 202 and a lower mounting surface 214 that is disposed either directly or indirectly on or above the cooktop surface 114. In the illustrated example, the lower mounting surface 214 is mounted or coupled directly on the cooktop surface 114. However, in other embodiments, for example as illustrated in FIGS. 7A-7C, the lower mounting surface 214 is mounted or coupled on an intervening part that is disposed on or above the cooktop surface 114. In other embodiments, the lower mounting surface 214 can include one or more recesses, protrusions, cutouts, stepped portions, alignment features, etc. that engage an opening or corresponding feature of the cooktop surface 114 or an intervening part to secure the burner body 200 to the cooktop surface 114 or align the burner body 200 on the cooktop surface 114.

As shown in FIG. 6, the sidewall 206 of the burner portion 202 can be tapered by a predetermined amount such that a periphery of the burner portion 202, or an area of the burner portion 202, increases in a vertical direction from the lower surface 208 of the burner portion 202 up to the upper surface of the burner portion 202, or at least up to the plurality of burner ports 210 of the burner portion 202, in order to promote and/or guide a flow of secondary air flowing along the periphery of the sidewall 206 of the burner portion 202 to the plurality of burner ports 210 of the burner portion 202. One of ordinary skill in the art will recognize that the amount of taper can be determined based on, for example, a desired amount of flow promotion, a desired shape or size, manufacturing considerations such as removal of a cast part from a mold or die, etc. In other embodiments, the sidewall 206 of the burner portion 202 can be substantially vertical such that a periphery of the burner portion 202, or an area of the burner portion 202, remains substantially the same in a vertical direction extending away from the cooktop surface 114.

Referring again to FIG. 6, the sidewall 212 of the base portion 204 can be tapered such that a width of the base portion 204, or an area of the base portion 204, increases in a vertical direction extending away from the cooktop surface 114. For example, as shown in FIG. 6, a periphery of the base portion 204 increases continuously in a vertical direction from the lower mounting surface 214 up to the lower surface 208 of the burner portion 202. These feature may be beneficial for promoting a flow of secondary air along the surface of the base portion 204. One of ordinary skill in the art will recognize that the amount of taper can be determined based on, for example, a desired amount of flow promotion, a desired shape or size, manufacturing considerations such as removal of a cast part from a mold or die, etc. In other embodiments, the sidewall 212 of the base portion 204 can be substantially vertical such that a width of the base portion 204, or an area of the base portion 204, remains substantially the same in a vertical direction extending away from the cooktop surface 114.

Referring again to the example in FIG. 6, the lower mounting surface 214 of the base portion 204 intersects or interfaces with the cooktop surface 114 at interface 250. As explained above, interfaces between adjoining parts, sharp angles or curves, and/or intricate shapes may be more susceptible to trapping or capturing food or spills than flat, smooth, or gradually curved surfaces. The present invention recognizes that the susceptibility of trapping or capturing food or spills may increase as the length of the interface increases and/or as the intricacy of the shape of the interfacing parts increases. As shown in FIG. 6, an area A1 of a footprint of the lower mounting surface 214 of the base portion 204 is less than an area A2 of a footprint of the lower surface 208 of the burner portion 202. The footprint (e.g., the size, area, length, size and shape (or outline), length and shape (or outline), or area and shape (or outline), etc.) of the lower mounting surface 214 of the base portion 204 of the burner body 200 has no correlation (e.g., no mathematical correlation) with the bottom, or footprint, of the lower surface 208 of the burner portion 202 of the burner body 200. For example, in an aspect, the size and shape of the footprint of the lower mounting surface 214 is independent from the size and shape of the footprint of the lower surface 208 of the burner portion 202. In another aspect, the area and/or the length of the perimeter of the footprint of the lower mounting surface 214 is less than the area or the length of the perimeter of the burner 120. As a result, the base portion 204 decouples (i.e., eliminates the interrelationship between) the footprint, shape, and/or size of the burner portion 202 from the interface 250 with the cooktop surface 114, thereby reducing or minimizing the susceptibility of trapping or capturing food or spills irrespective of the footprint, shape, and/or size of the burner portion 202. In this way, a shape, size, and/or arrangement of the burner portion 202 can be configured to, for example, improve cooking characteristics of the burner with little or no effect on the cleanability of the cooktop surface 114 under or around the burner 120.

Referring again to FIG. 6, the base portion 204 increases a horizontal distance X1 (e.g., a predetermined horizontal distance) between the flames of the burner 120 and the interface 250 between the base portion 204 and the cooktop surface 114, thereby reducing or preventing the flame from the burner 120 from heating or baking a spill (e.g., a liquid or solid) onto the surface of the cooktop, and more particularly at the interface 250 which is more difficult to clean, and improving the ease with which the cooktop surface 114 may be cleaned.

Referring again to FIG. 6, the base portion 204 provides a vertical clearance C1 (e.g., a predetermined vertical clearance) between the lower surface 208 of the burner portion 202 and the cooktop surface 114, thereby making it easier for a user to access and clean the surface of the cooktop 114 under the burner portion 202, and particularly, easier for a user to access and clean the interface 250 between the base portion 204 and the cooktop surface 114. For example, the assembly of the burner body 200 on the cooktop surface 114 can be configured to provide a minimum clearance C1 of equal to or greater than 19 mm in order to provide sufficient space for a user to clean under the burner portion 202, while at the same time providing a low-profile burner 120.

The present invention has determined that a minimum clearance C1 of approximately 19 mm between the underside of the burner portion 202 and the cooktop surface 114 provides sufficient clearance to allow access for common finger sizes along with a cleaning cloth or fabric into the space between the underside of the burner portion 202 and the cooktop surface 114 to clean around the base portion 204, or to clean the intersection 250 between the base portion 204 and the cooktop surface 114. The minimum clearance of 19 mm can be provided between the underside of the burner portion 202 and the cooktop surface 114 when measured at or near the perimeter of the burner portion 202. However, in other embodiments, the minimum clearance of 19 mm can be provided between the underside of the burner portion 202 and the cooktop surface 114 when measured at or near the intersection of the base portion 204 with the burner portion 202, thereby providing sufficient clearance to allow access for common finger sizes along with a cleaning cloth or fabric into the space all the way to the base portion 204 and the intersection 250 between the base portion 204 and the cooktop surface 114.

The lower surface 208 can be tapered such that the clearance is greater at a perimeter of the burner portion 202 than at an intersection of the burner portion 202 with the base portion 204, thereby making it easier for a user to clean under the burner portion 202. Additionally or alternatively, the tapered lower surface 208 can promote and/or guide a flow of secondary air flowing along the lower surface 208 and onto the sidewall 206 of the burner portion 202 to the plurality of burner ports 210 of the burner portion 202. One of ordinary skill in the art will recognize that the amount of taper can be determined based on, for example, a desired amount of clearance, a desired amount of flow promotion, a desired shape or size, as well as manufacturing considerations such as removal of a cast part from a mold or die, etc. In other embodiments, the lower surface 208 can be horizontally arranged such that the clearance is substantially the same from the perimeter of the burner portion 202 to the intersection of the burner portion 202 with the base portion 204.

As shown in FIG. 6, the sidewall 206 of the burner portion 202 can be tapered by a predetermined amount such that a periphery of the burner portion 202, or an area of the burner portion 202, increases in a vertical direction from the lower surface 208 of the burner portion 202 up to the upper surface of the burner portion 202, or at least up to the plurality of burner ports 210 of the burner portion 202, in order to promote and/or guide a flow of secondary air flowing along the periphery of the sidewall 206 of the burner portion 202 to the plurality of burner ports 210 of the burner portion 202. One of ordinary skill in the art will recognize that the amount of taper can be determined based on, for example, a desired amount of flow promotion, a desired shape or size, manufacturing considerations such as removal of a cast part from a mold or die, etc. In other embodiments, the sidewall 206 of the burner portion 202 can be substantially vertical such that a periphery of the burner portion 202, or an area of the burner portion 202, remains substantially the same in a vertical direction extending away from the cooktop surface 114.

The intersections between the surface of the sidewall 212 of the base portion 204 and the lower surface 208 of the burner portion 202 can be tapered, angled, and/or curved at one or more locations, or continuously along a length of the intersection, in order to promote and/or guide a flow of secondary air flowing from one surface to the next surface, improve ease of manufacturing, etc. Similarly, the intersections between the lower surface 208 of the burner portion 202 and one or more portions of the sidewall 206 of the burner portion 202 can be tapered, angled, and/or curved at one or more locations, or continuously along a length of the intersection, in order to promote and/or guide a flow of secondary air flowing from one surface to the next surface, improve ease of manufacturing, etc.

As shown in FIG. 6, the clearance C1 generally corresponds to a height of the base portion 204 when the mounting surface 214 of the base portion 204 is mounted directly on the cooktop surface 114. In other embodiments of the home cooking appliance, the lower mounting surface 214 can be mounted on an intervening part that is mounted on or above the cooktop surface 114 and/or on a volcano-style pedestal that is integrally formed on the cooktop surface. For example, referring to FIGS. 7A-7C, the burner 120 can be mounted on a volcano-style pedestal 122 and/or a similar structure 122*a* extending in a vertical direction from the cooktop surface 114. In these exemplary arrangements of the home cooking appliance, the clearance C2 generally equals a sum of the height of the base portion 204 and a height of the volcano-style pedestal 122 and/or a similar structure 122*a* extending in a vertical direction from the cooktop surface 114. For example as shown in FIGS. 7A-7C, the assembly of the burner body 200 on the cooktop surface 114 can be configured to provide a minimum clearance C2 of equal to or greater than 19 mm in order to provide sufficient space for a user to clean under the burner portion 202, while at the same time providing a low-profile burner 120. In an embodiment in which the burner 120 is mounted on an intervening part, a volcano-style pedestal 122, or a similar structure extending in a vertical direction from the cooktop surface 114, a height of the base portion 204 can be minimized to provide a low profile burner 120 on the cooktop surface 114 that provides sufficient clearance C2 (e.g., equal to or greater than 19 mm) for cleaning while at the same time decoupling (i.e., eliminates the interrelationship between) the size and shape of the footprint of the lower mounting surface 214 of the base portion 204 from the size and shape of the footprint of the lower surface 208 of the burner portion 202.

Similar to the exemplary embodiment in FIG. 6, the present invention has determined that a minimum clearance C2 of approximately 19 mm between the underside of the burner portion 202 and the cooktop surface 114, in the exemplary embodiments of FIGS. 7A-7C, provides sufficient clearance to allow access for common finger sizes along with a cleaning cloth or fabric into the space between the underside of the burner portion 202 and the cooktop surface 114 to clean around the base portion 204, or to clean the intersection 250 between the base portion 204 and the cooktop surface 114. The minimum clearance of 19 mm can be provided between the underside of the burner portion 202 and the cooktop surface 114 when measured at or near the perimeter of the burner portion 202. However, in other embodiments, the minimum clearance of 19 mm can be provided between the underside of the burner portion 202 and the cooktop surface 114 when measured at or near the intersection of the base portion 204 with the burner portion 202, thereby providing sufficient clearance to allow access for common finger sizes along with a cleaning cloth or fabric into the space all the way to the base portion 204 and the intersection 250 between the base portion 204 and the cooktop surface 114, the "volcano-style" pedestal 122, and/or the intervening part 122*a*.

Referring again to FIGS. 6 and 7A-7C, the base portion 204 elevates the burner portion 202 above the cooktop surface 114, thereby increasing a vertical distance Y1, Y2 (e.g., a predetermined vertical distance) between the cooktop surface 114 and an upper surface of the sidewall 206 of the burner portion 202 (e.g., upper surface 220 of the sidewall 206 shown in FIGS. 9-16, where the flame kernel is produced at burner ports 210), thereby reducing or preventing discoloration of the surface of the cooktop caused by the flame, for example, over a period of time and use, thereby improving a user's satisfaction with the appearance of the appliance. The present invention recognizes that 304 stainless steel discolors at 200° C. As illustrated by the Table in FIG. 7D, a minimum clearance (e.g., Y1 in FIG. 6 or Y2 in FIGS. 7A-7C) of approximately 25 mm between the cooktop surface and an upper surface (e.g., 220 shown in FIGS. 9-16) of the sidewall 206 of the burner portion 202 (i.e., where the flame kernel is produced at burner ports 210) results in a measured cooktop surface temperature of 186° C. Since this temperature is less than 200° C., the present invention can effectively minimize or prevent discoloration of a cooktop surface formed using 304 stainless steel.

These features also may reduce or prevent the flame from the burner 120 from heating or baking a spill (e.g., a liquid or solid) onto the surface of the cooktop 114, and thereby further improving the ease with which the cooktop 114 can be cleaned. That is, the aspects of the invention can reduce or minimize the radiative energy transferred to the surface of the cooktop 114 from the flame of the burner portion 202, thereby reducing or minimizing the temperature of the surfaces of the appliance that are adjacent to the burner during operation of the burner, as well as food or spills laying on the surface of the cooktop 114. As a result, even if food or spills are trapped or captured along the interface 250, the food or spills may not be baked on, thereby making the food or spill easier to clean.

As will be explained in greater detail below, the size, shape, etc. of the base portion 204, and particularly the perimeter or footprint of the lower mounting surface 214 of the base portion 204, can be configured to minimize a susceptibility of food or spills to be trapped or captured at the intersection 250 between the base portion 204 and the volcano-style pedestal 122 of the cooktop surface 114. For example, the size, shape, etc. of the base portion 204, and particularly the perimeter or footprint of the lower mounting surface 214 of the base portion 204, can correspond to one or more of the size or shape of a perimeter or footprint of an upper mounting surface of the volcano-style pedestal 122 of the cooktop surface 114 and/or a similar structure 122*a* extending in a vertical direction from the cooktop surface 114. For example, one or more of an intervening part, a volcano-style pedestal 122, or a similar structure 122*a* extending in a vertical direction from the cooktop surface 114 can have a circular shape, an oval shape, a tear-drop shape, or another shape footprint that corresponds to a shape of the footprint of the lower mounting surface 214 of the base portion 204.

Figure 8:
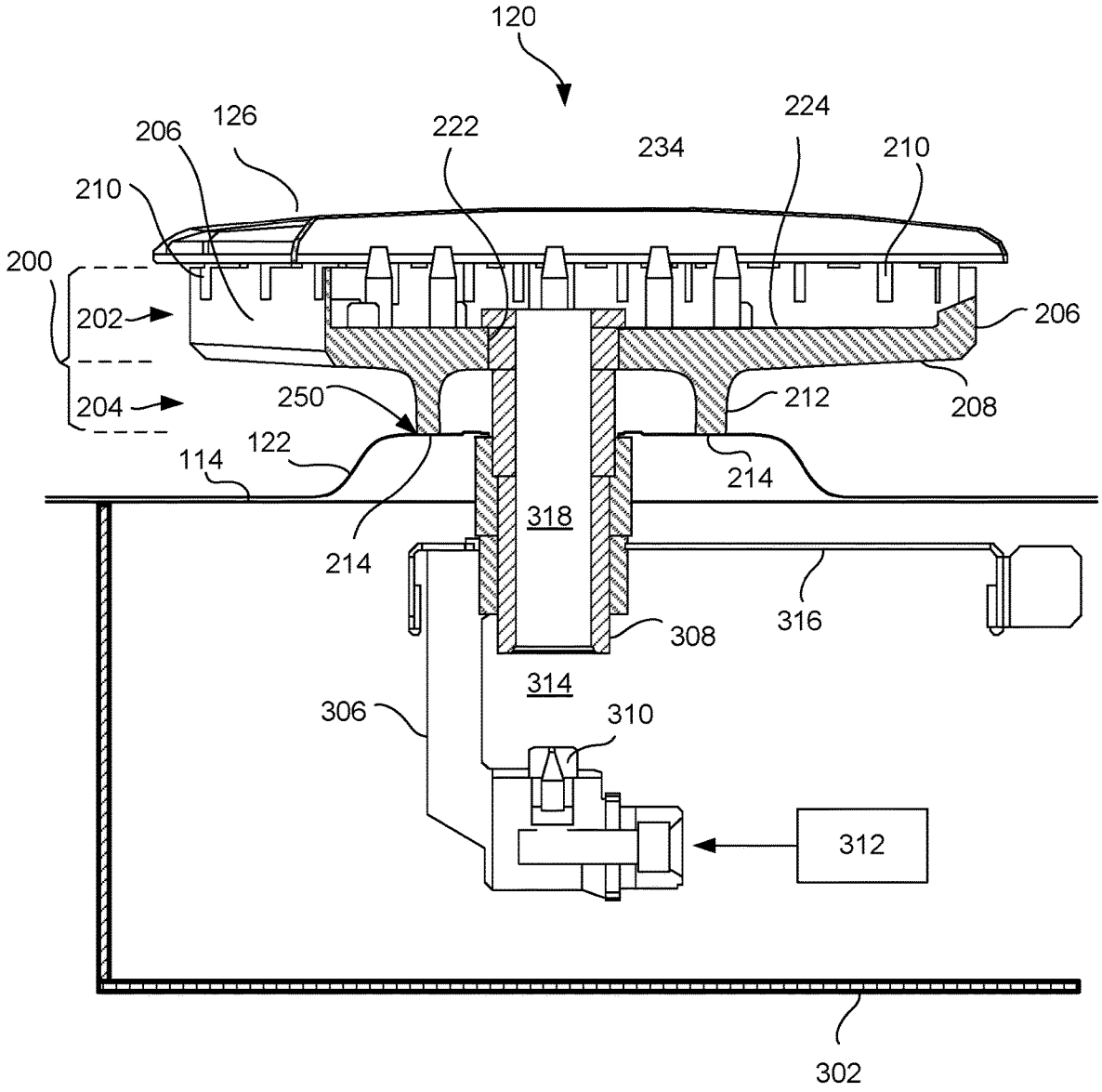
FIG. 8 is a partial cross-sectional view of a home cooking appliance having a volcano-style cooktop surface according to another embodiment of the invention.

FIG. 8 is a partial cut-away view of a burner 120 on a cooktop surface 114 having a volcano-style pedestal 122 similar to FIG. 7A. As shown in FIG. 8, the housing of the home cooking appliance has an interior box or a rough-in box 302 that encloses the cooktop controls and gas nozzle 310 inside a cooking appliance 100, such as a range, or under a cooktop for installation in a rough-in opening in a cabinet or countertop. The rough-in box 302 may include a bottom wall to prevent spillage through the openings in the cooktop surface from soiling the interior of the range or cabinet. In addition, the rough-in box 302 may provide support for a jet holder 306. An additional bracket 316 also may be provided to support the jet holder 306. As shown in FIG. 8, a venturi tube 308 includes an elongated body having a venturi passage 318. The body of the venturi tube 308 may include an exterior, threaded portion adapted to receive a nut to lock the venturi tube 308 into position in the opening of the cooktop surface 114, under the cooktop surface 114, or inside or on the burner body 200. The lower end of the venturi tube 308 is received in a jet holder 306 and the upper end of the venturi tube 308 is received in, or extends through, an opening 222 in an inner bottom surface 224 of the burner portion 202 of the burner body 200, which will be described in greater detail below. The base portion 204 of the burner body 200 can include a hollow cavity (lower cavity) or an opening or passageway for permitting the venture tube 308 to pass through to an upper cavity in the burner portion 202. The opening 222 in the inner bottom surface 224 of the burner portion 202 and the lower cavity, opening, or passageway in the base portion 204 can be integrally formed, for example, having the same size and/or shape, or separately formed, for example, with different sizes and/or shapes. The burner portion 202 of the burner body 200 can include, for example, one or more burner head tabs, projections, slots, or other alignment features (e.g., 234) for locating, aligning, and/or securing the burner cap 126 to the burner body 200.

The jet holder 306 may be supported by the rough-in box 302 or another support. The jet holder 306 may be mounted in the opening of the cooktop surface 114 or under the cooktop surface 114. The jet holder 306 positions a gas nozzle 310 for introducing gas for mixture with air and entry into the venturi passage 318 as is known conventionally. The nozzle 310 is coupled to a supply of gas 312 and discharges the fuel to a mixing zone 314 adjacent the entry to the venturi passage 318.

In this example, the gas burner 120 is a sealed gas burner. The lower mounting surface 214 of the base portion 204 rests on the surface of the volcano-style pedestal 122 of the cooktop surface 114, and in some exemplary aspects, can be configured to form a seal against the surface of the volcano-style pedestal 122 of the cooktop surface 114. In other embodiments of a sealed gas burner, the lower mounting surface 214 of the base portion 204 rests on, or is supported by, the surface of an intervening part (such as a separate burner base structure) or a similar structure extending in a vertical direction from the cooktop surface 114, and in some exemplary aspects, is configured to form a seal against the surface of an intervening part or a similar structure extending in a vertical direction from the cooktop surface 114.

In operation, the supply of gas 312 is delivered through the nozzle 310 and mixed with air at the mixing zone 314. The air-gas mixture enters a venturi passage 318 for delivery to the burner portion 202 of the burner 120. The air-gas mixture then passes through the burner ports 210 such that, upon ignition by an appropriate ignitor (e.g., 140 in FIG. 5), a flame may be initiated and sustained at the perimeter of the sidewall 206 of the burner portion 202 and the burner cap 126 of the burner 120. The burner body 200 can improve a flow of secondary air radially inward from the sides of the burner 120 to each flame at the burner ports 210, thereby improving initiation of the flames of the burner 120 and helping to sustain consistent flames of the burner 120.

It is noted that other arrangements of the burner 120, venturi tube 308, and gas nozzle 310 may be provided without departing from the spirit and scope of the present invention. For example, in another aspect, the venturi tube 308 may be integrally formed with the burner body 200. In other embodiments, the arrangement of the burner 120 and cooktop surface 114 can be a seal or a non-sealed burner arrangement having a pedestal burner 200.

Referring to FIGS. 9-16, exemplary embodiments of a burner body 200 will now be described.

Figure 9:
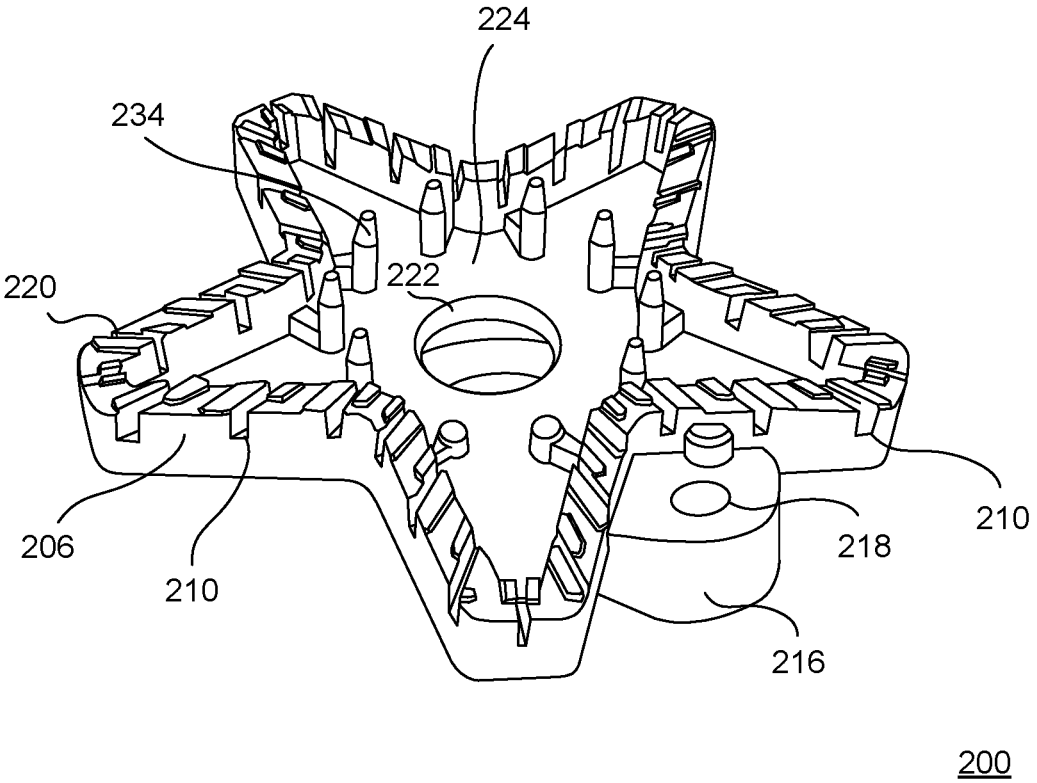
FIG. 9 is a perspective view of a plurality-fingered pedestal burner for a home cooking appliance according to an embodiment of the invention.
Figure 10:
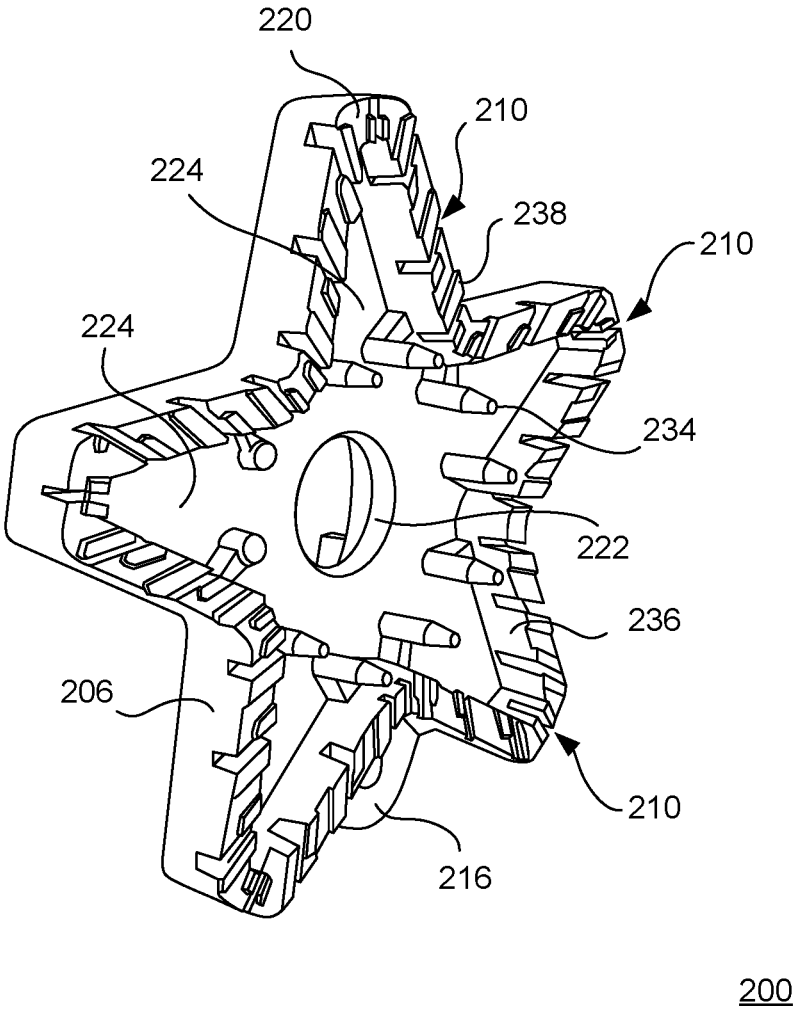
FIG. 10 is another perspective view of a plurality-fingered pedestal burner for a home cooking appliance according to an embodiment of the invention.
Figure 11:
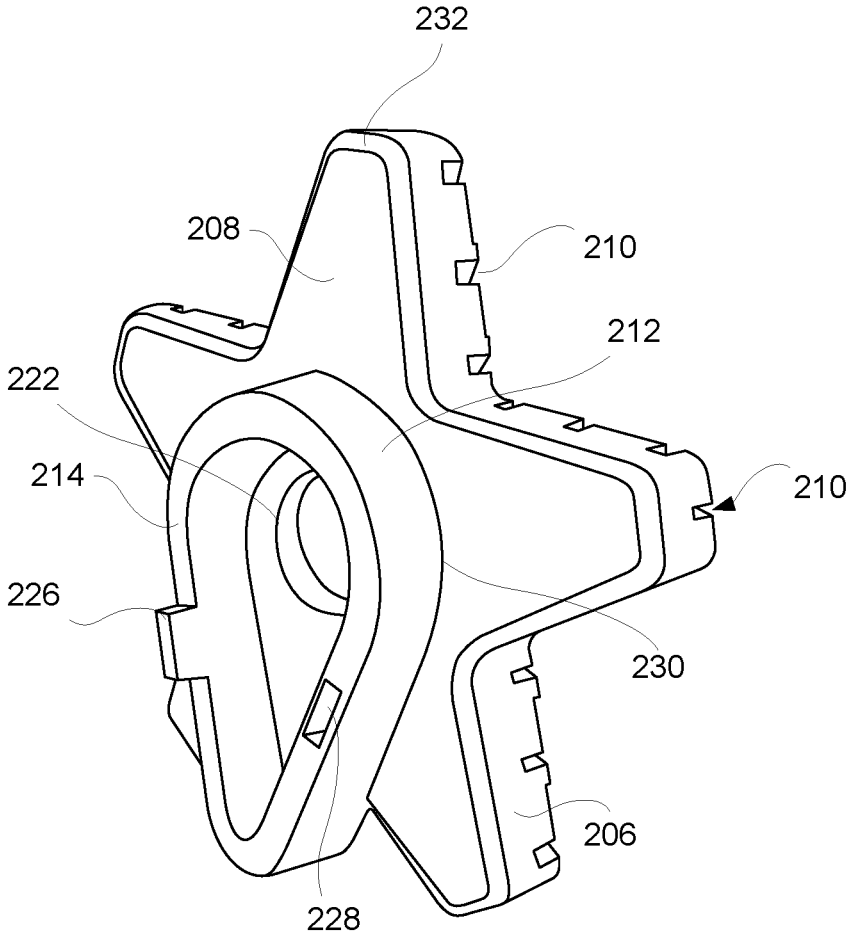
FIG. 11 is another perspective view of a plurality-fingered pedestal burner for a home cooking appliance according to an embodiment of the invention.
Figure 12:
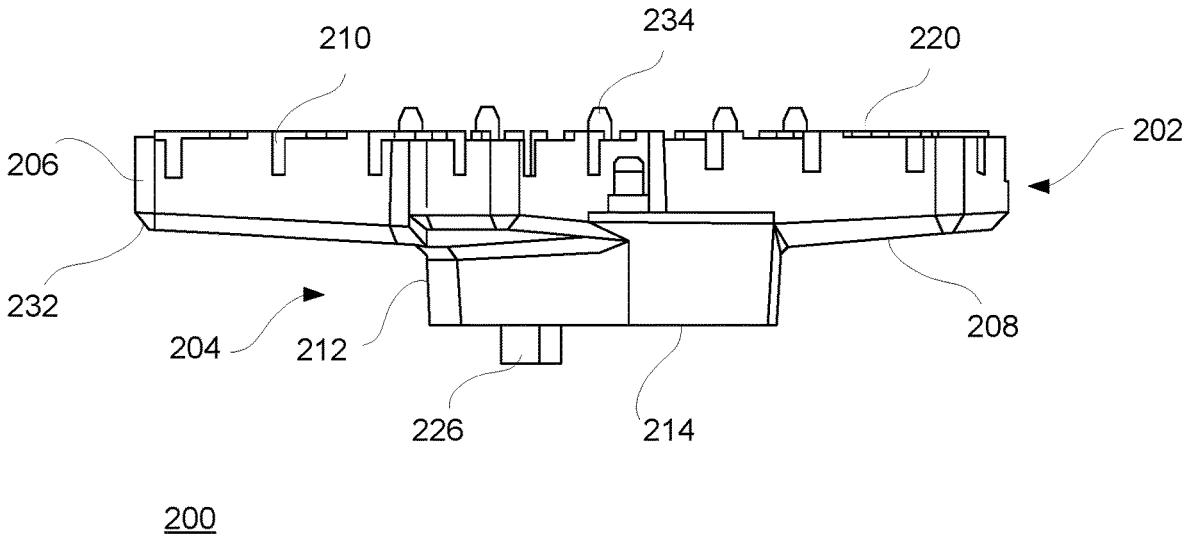
FIG. 12 is a side view of a plurality-fingered pedestal burner for a home cooking appliance according to an embodiment of the invention.
Figure 13:
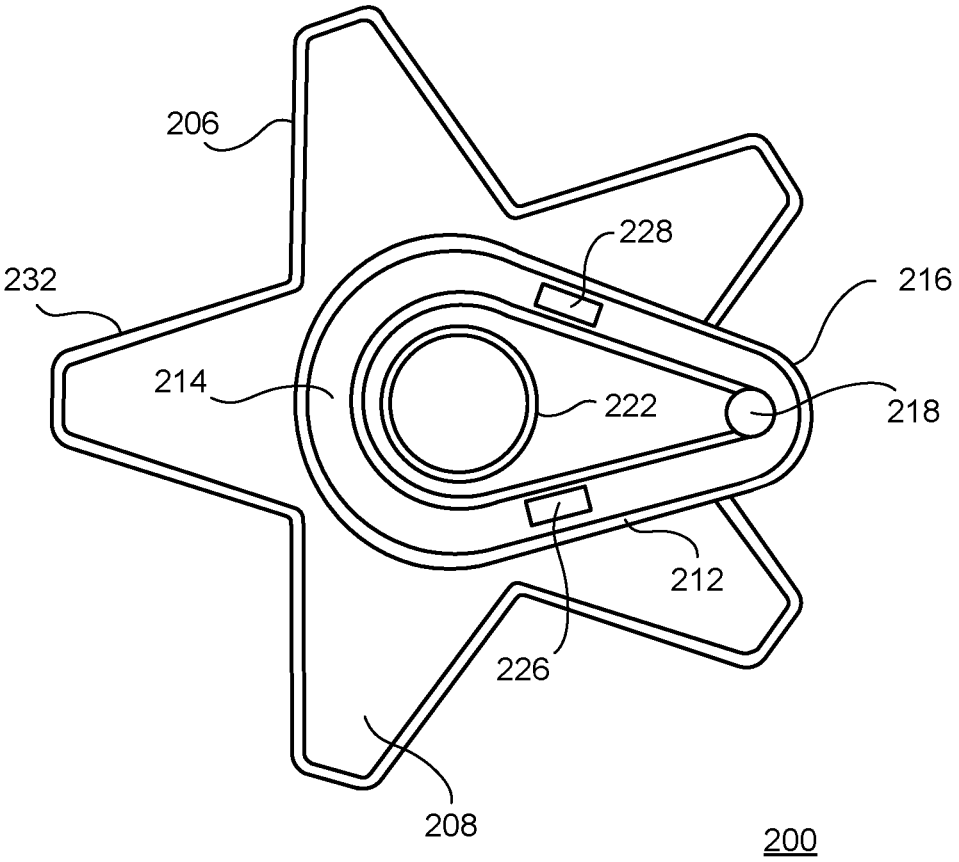
FIG. 13 is a bottom view of a plurality-fingered pedestal burner for a home cooking appliance according to an embodiment of the invention.
Figure 14:
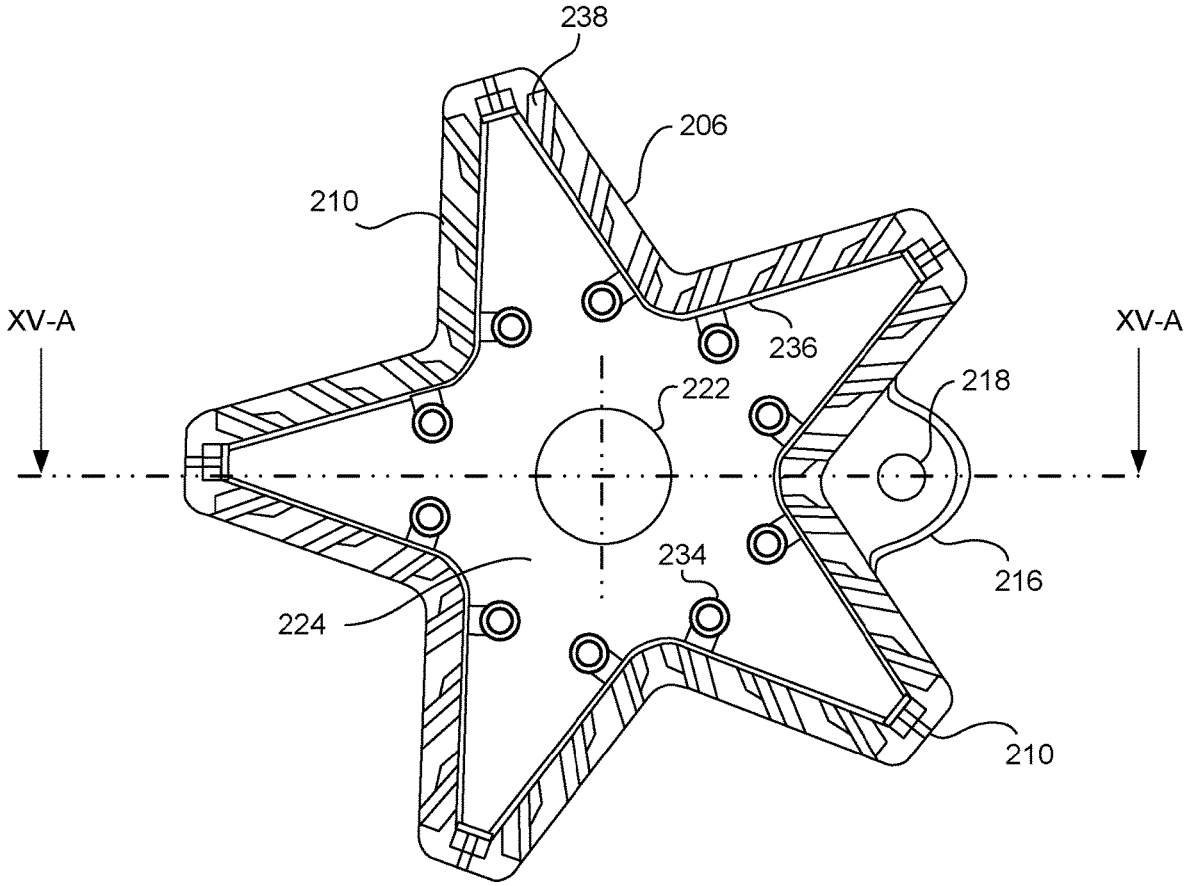
FIG. 14 is a top view of a plurality-fingered pedestal burner for a home cooking appliance according to an embodiment of the invention.
Figure 15:
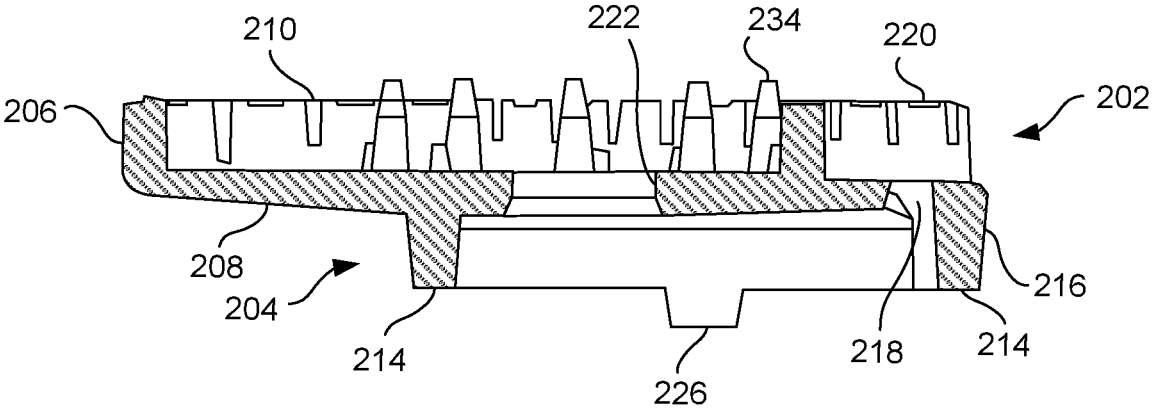
FIG. 15 is a cross-sectional view of a plurality-fingered pedestal burner for a home cooking appliance taken along section XV-A in FIG. 14, according to an embodiment of the invention.

As shown for example in FIGS. 9 and 10, the burner portion 202 of the burner body 200 can include a plurality of fingers defined by the sidewall(s) 206 and generally forming a star shape. In this aspect, the burner portion 202 has five fingers that form a star configuration corresponding to the star configuration or upper footprint of the burner 120 shown in FIG. 5. One of ordinary skill in the art will recognize that other numbers of fingers, configurations, sizes, shapes, etc. can be provided. For example, the burner portion 202 may have a circular or oval shaped configuration. FIG. 9 shows the opening 222 in the inner bottom surface 224 of the burner portion 202 that receives the venturi passage 318 (shown in FIG. 8) and facilitates the flow of the air-gas mixture from the venturi passage 318 into an upper cavity defined by the inner bottom surface 224 and the inner sidewall surface 236 of the sidewalls 206 of the burner portion 202, along with the burner cap 126. The air-gas mixture then passes from the upper cavity through the burner ports 210 for ignition by an appropriate ignitor (e.g., 140 in FIG. 5). The burner ports 210 generally are illustrated as having substantially the same width and/or depth at each location around the sidewall 206. In other embodiments, one or more of the burner ports 210 can have a different width and/or depth in the sidewall 206. The burner ports 210 can extend through the sidewall 206 at an angle normal to the surface of the sidewall or at another angle with respect to the side wall. In the example, the burner ports 210 at each tip of the fingers extend at an angle normal to the surface of the sidewall 206, while the burner ports 210 disposed along the sides of the fingers are arranged at an angle with respect to the side wall 206. One of ordinary skill will recognize that the size, shape, and orientation (e.g., angle) can be provided to promote a predetermined flow of the air-gas mixture from the space within the burner portion 202 through the burner ports 210. The locations of the burner ports 210 are not limited to the illustrated embodiments and can be formed in one or more of the sidewall of the burner portion, in an upper surface of the sidewall of the burner portion, and/or in an upper surface, cover, or cap of the burner portion.

In this example, the burner portion 202 includes a plurality of burner head tabs 234 for locating, aligning, and/or securing the burner cap 126 to the burner body 200. An upper surface 220 of the sidewall 206 can include one or more projections 238 for supporting the burner cap 126 on the burner body 200, and particularly, for supporting the burner cap 126 in a spaced position above the upper surface 220 of the sidewalls 206 of the burner body 200.

Referring again to FIGS. 9-16, and particularly FIGS. 11-13, the burner body 200 includes a burner portion 202 having a lower surface 208 and a base portion 204 having a sidewall 212 that intersects at 230 with the lower surface 208 of the burner portion 202. The lower surface 208 of each finger is tapered. Additionally, in this example, the intersection between the lower surface 208 and the sidewalls 206 includes a tapered or angled edge 232. As explained above, the lower mounting surface 214 of the base portion 204 can include one or more recesses, protrusions, cutouts, stepped portions, alignment features, etc. that engage an opening or corresponding feature of the cooktop surface 114 or an intervening part to secure the burner body 200 to the cooktop surface 114 or align the burner body 200 on the cooktop surface 114. In this example, the mounting surface 214 includes a protrusion 226 and a cutout or slot 228 for aligning and securing the burner body 200 to a cooktop surface 114 or an intervening part.

Referring again to FIGS. 9-16, and particularly FIGS. 11-15, an area of a footprint of the lower mounting surface 214 of the base portion 204 is less than an area of a footprint of the lower surface 208 of the burner portion 202. The footprint (e.g., the size, area, length, size and shape (or outline), length and shape (or outline), or area and shape (or outline), etc.) of the lower mounting surface 214 of the base portion 204 of the burner body 200 has no correlation (e.g., no mathematical correlation) with the bottom, or footprint, of the lower surface 208 of the burner portion 202 of the burner body 200. For example, in an aspect, the size and shape of the footprint of the lower mounting surface 214 is independent from the size and shape of the footprint of the lower surface 208 of the burner portion 202. In another aspect, the area and/or the length of the perimeter of the footprint of the lower mounting surface 214 is less than the area or the length of the perimeter of the burner portion 202.

As explained above, the lower mounting surface 214 of the base portion 204 can have a circular shape, an oval shape, a tear-drop shape, or another shape footprint. In the example illustrated in FIGS. 9-15, the lower mounting surface 214 of the base portion 204 has a tear-drop shape. A narrow end of the tear-drop shape extends between two of the fingers of the burner portion 202 and forms an ignitor surface 206 disposed between the two fingers of the burner portion 202. The ignitor surface 206 has an opening 218 configured to receive an ignitor 140 (shown in FIG. 5) for igniting the air-gas mixture flowing from the burner ports 210 during operation.

Figure 16:
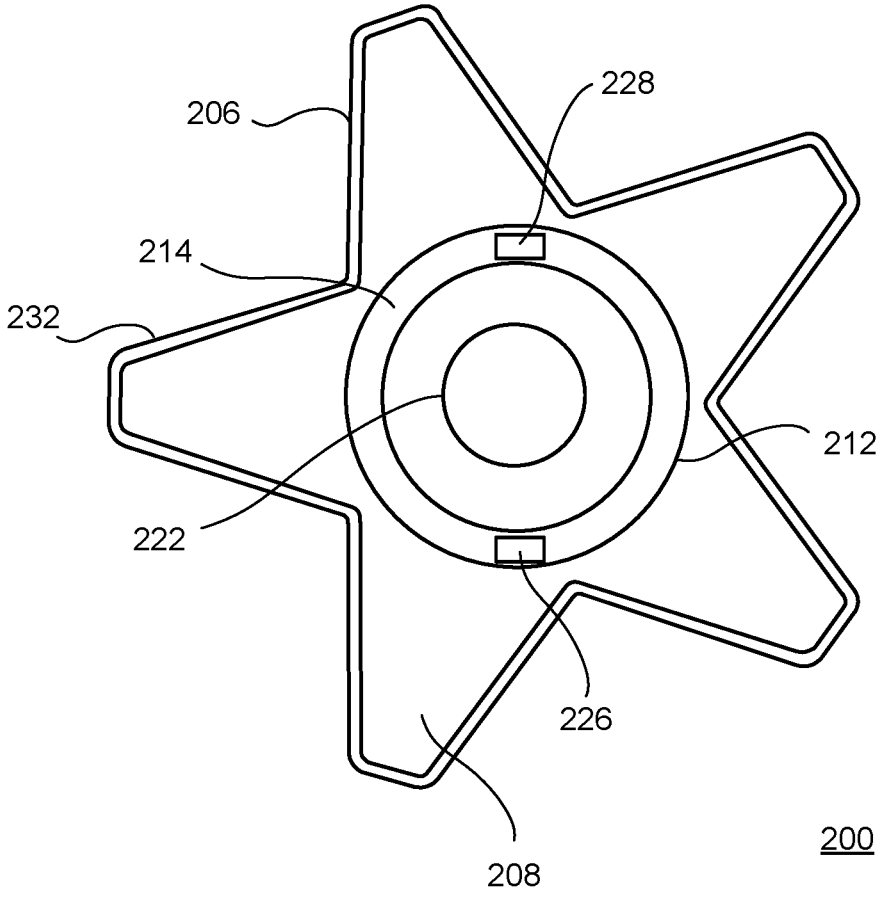
FIG. 16 is a bottom view of a plurality-fingered pedestal burner for a home cooking appliance according to another embodiment of the invention.

Referring to FIG. 16, another exemplary embodiment of a burner body 200 is illustrated in which a lower mounting surface 214 of the base portion 204 has a circular shape. In these example aspects, the ignitor and/or ignitor support can be separate from the pedestal and disposed adjacent to the pedestal at a height and/or distance that is sufficient for igniting the air-gas mixture flowing from the burner 120. For example, an ignitor may be provided on the cooktop surface 114, on another intervening part, or on an adjacent part for igniting the air-gas mixture flowing from the burner ports 210 during operation.

With reference again to FIGS. 8-16, and as explained above, the burner body 200 can include an opening 222 fluidly connecting an upper cavity defined by the inner bottom surface 224 and the inner sidewall surfaces 236 of the sidewalls 206 and a lower cavity, opening, or passageway formed in the burner portion 204. One or more of the inner bottom surface 224 and the inner sidewall surfaces 236 of the sidewalls 206 of the burner portion can be tapered to promote a desired flow of the air-gas mixture, to facilitate removal of the part from a mold or die, etc. Alternatively, the inner bottom surface 224 can be parallel to a plane of the upper surface 220 of the burner portion 202, and/or the inner sidewall surfaces 236 of the sidewalls 206 of the burner portion 202 can be perpendicular to the upper surface 220. One of ordinary skill in the art will recognize that various combinations of perpendicular, parallel, angled, tapered, and/or curved surfaces may be provided.

Similarly, inner surfaces of the lower cavity, opening, or passageway formed in the burner portion 204 can be tapered, for example, to promote a desired flow of the air-gas mixture, to facilitate removal of the part from a mold or die, to secure a venture tube within, etc. One of ordinary skill in the art will recognize that various cavity configurations are possible for promoting the flow of the air-gas mixture through the portions of the burner body 200. One of ordinary skill in the art will recognize that various outer surface configurations are possible for promoting the flow of secondary air over the surfaces of the burner body 200 to the burner ports 206.

With reference now to FIGS. 17-23, exemplary embodiments of a burner 120 having a burner portion 350 and a separate pedestal portion 400 will now be described. As explained above, in other exemplary embodiments, one or more of the burners 120 shown in FIG. 5 can include a burner portion 350, which includes a plurality of burner ports 424, and a separately formed pedestal portion 400 that elevates the burner portion 350 in a vertical direction above the cooktop surface 114. In some exemplary embodiments, an ignitor 140 for igniting the air-gas mixture flowing from the burner ports 210 can be mounted on a surface of the pedestal 400.

Referring to FIGS. 17-20G, the burner 120 includes a burner body 350 having a plurality of fingers. In this aspect, the burner 120 has five fingers that form a star configuration. One of ordinary skill in the art will recognize that other numbers of fingers and configurations can be provided, such as round or oval burners. A burner cap 126 having a plurality of fingers covers the burner body 350 to prevent leakage or overspills from cooking utensils from entering the burner 120. The burner body 350 and burner cap 126 define an interior chamber. The burner body 350 includes a plurality of recesses forming burner ports 424. The burner ports 424 are in fluid communication with the chamber and the exterior of the burner 120 for permitting flow of the air-gas mixture from the burner 120.

Figure 17:
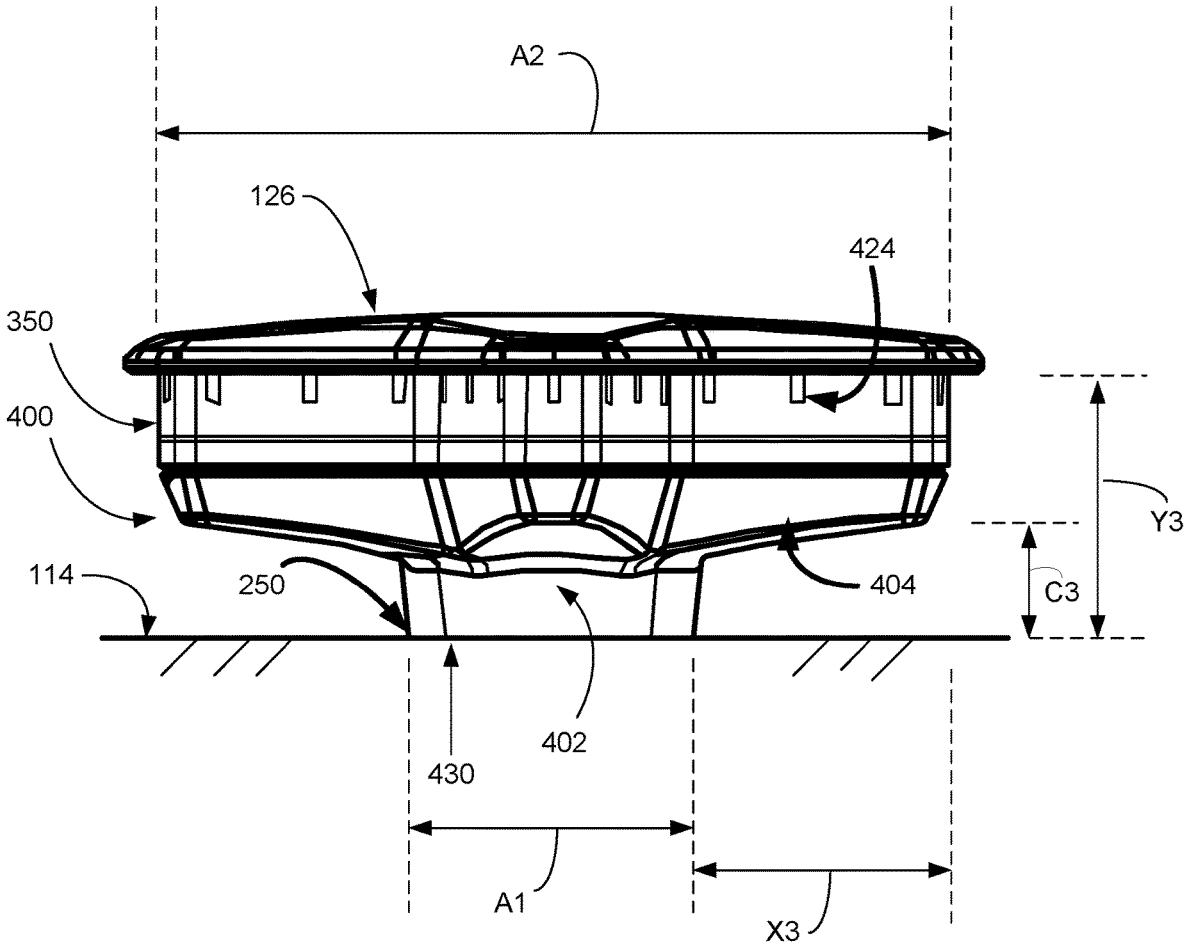
FIG. 17 is a side view of a plurality-fingered burner assembly for a home cooking appliance according to an embodiment of the invention.
Figure 18:
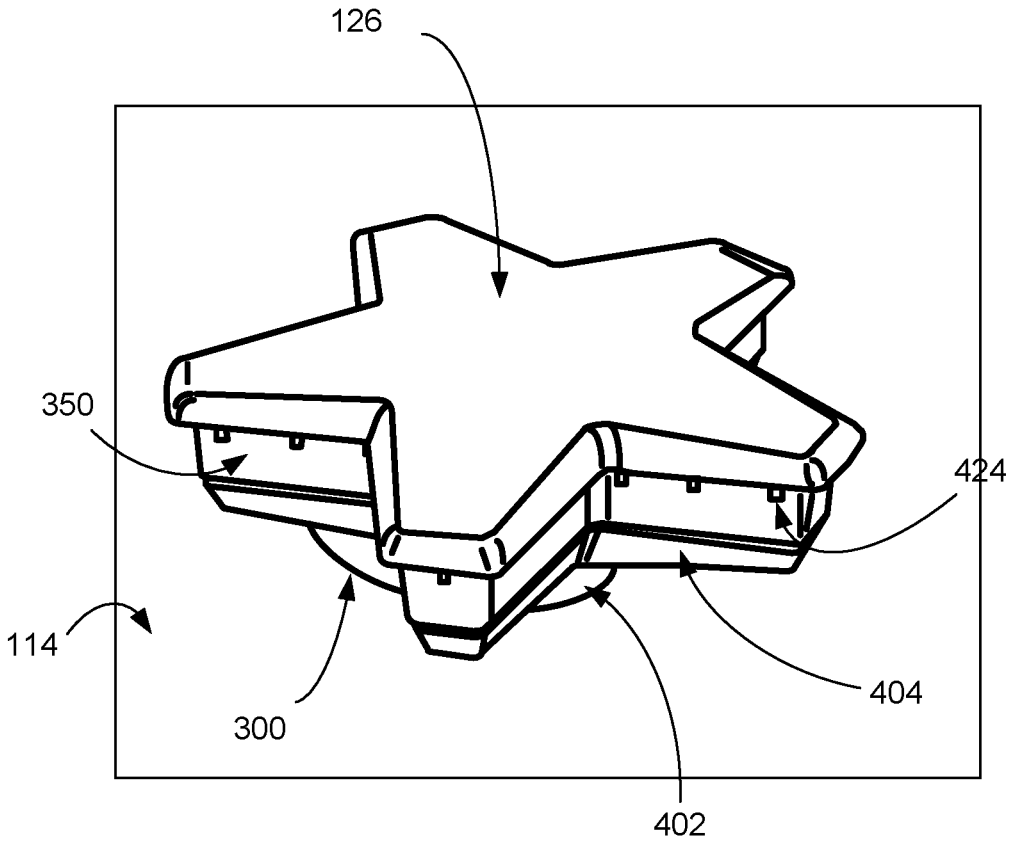
FIG. 18 is a perspective view of a plurality-fingered burner assembly for a home cooking appliance according to an embodiment of the invention.

As shown in FIGS. 17 and 18, the burner 120 is supported by or mounted on a pedestal 400. As set forth above, the burner body 350 and the pedestal 400 also may be integrally formed. The pedestal 400 elevates the burner body 350, thereby increasing a vertical distance Y3 (e.g., a predetermined vertical distance) between the flames of the burner 120 and the cooktop surface 114, thereby reducing or preventing the flame from the burner from heating or baking a spill (e.g., a liquid or solid) onto the surface of the cooktop, and improving the ease with which the cooktop can be cleaned.

The pedestal 400 includes a pedestal body (i.e., base portion) 402 having a lower surface 430 that is mounted on the cooktop surface 114. In another aspect, the pedestal body 402 can include a recessed portion (e.g., 480 shown in FIG. 20A) that is received in an opening of the cooktop surface 114 to secure the pedestal to the cooktop surface 114.

FIG. 18 shows the intersection or interface 250 of the lower surface 430 of the pedestal body 402 with the cooktop surface 114. The footprint (e.g., the size, area, length, size and shape (or outline), length and shape (or outline), or area and shape (or outline), etc.) of the lower surface 430 of the pedestal body 400 has no correlation (e.g., no mathematical correlation) with the bottom, or footprint, of the burner 120. For example, in an aspect, the size and shape of the footprint of the pedestal body 402 is independent from the size and shape of the footprint of the burner 120. In another aspect, the area and/or the length of the perimeter of the footprint of the pedestal body 402 is less than the area or the length of the perimeter of the burner 120. The pedestal body or base portion 402 decouples the footprint of the burner body 350 of the burner 120 from the cooktop surface 114.

Figure 19A:
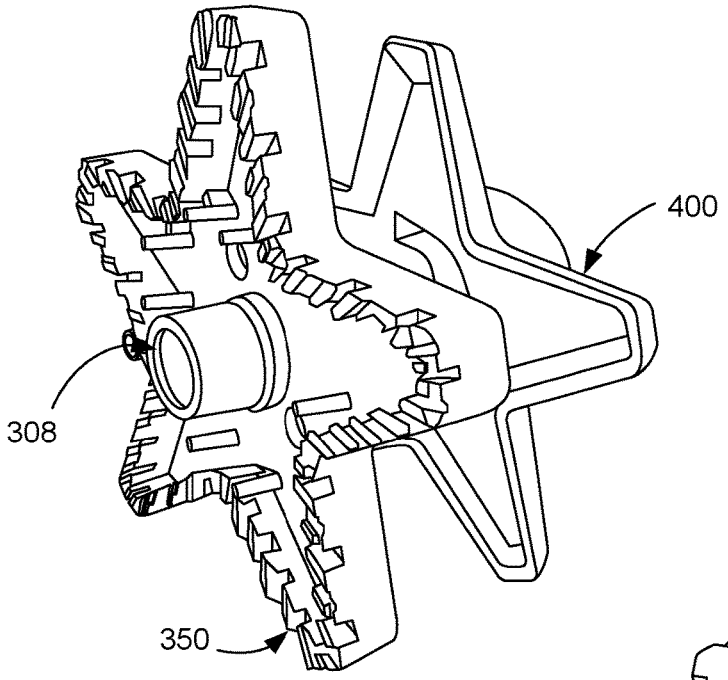
FIGS. 19A and 19B are partial exploded perspective views of a plurality-fingered burner assembly for a home cooking appliance according to an embodiment of the invention.
Figure 19B:
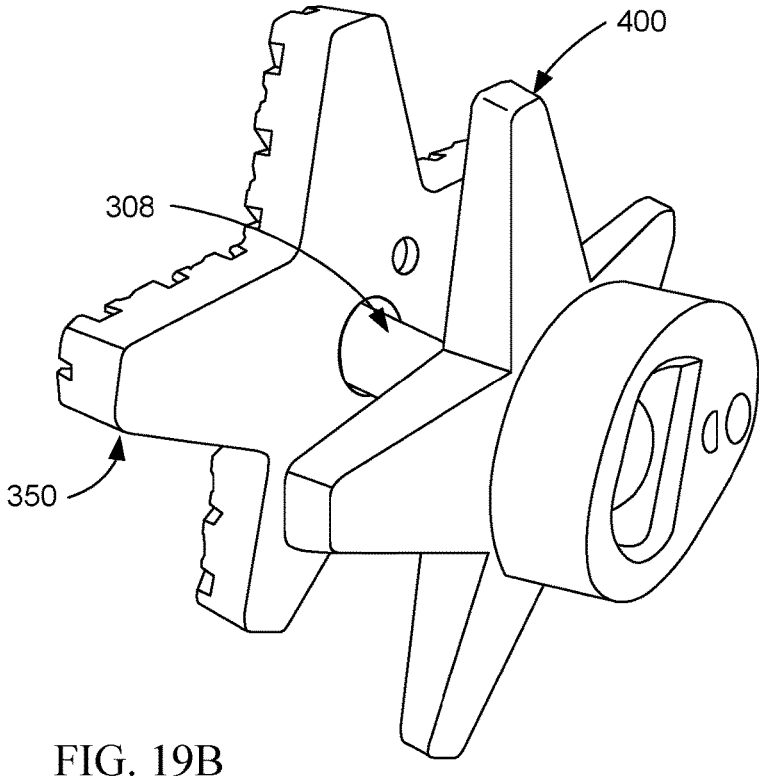
Figure 20A:
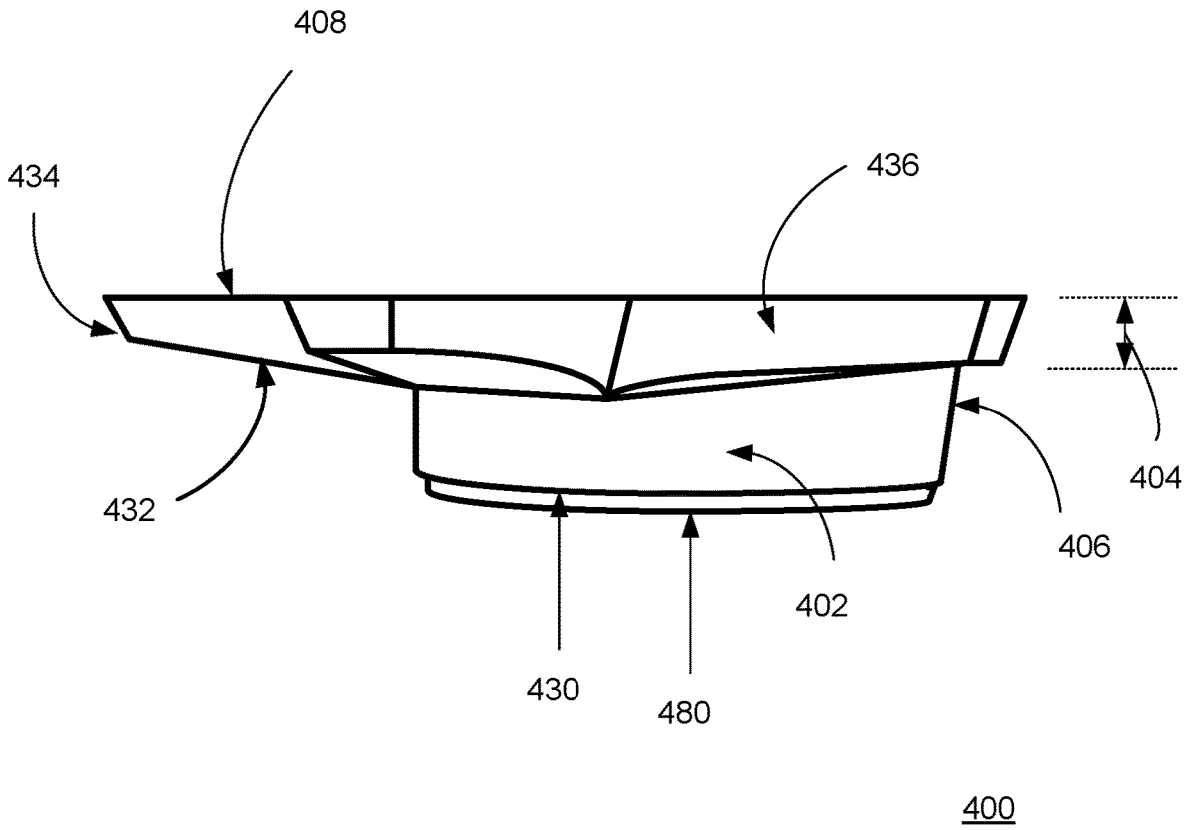
FIG. 20A is a first side view of a pedestal for a home cooking appliance according to an embodiment of the invention.
Figure 20B:
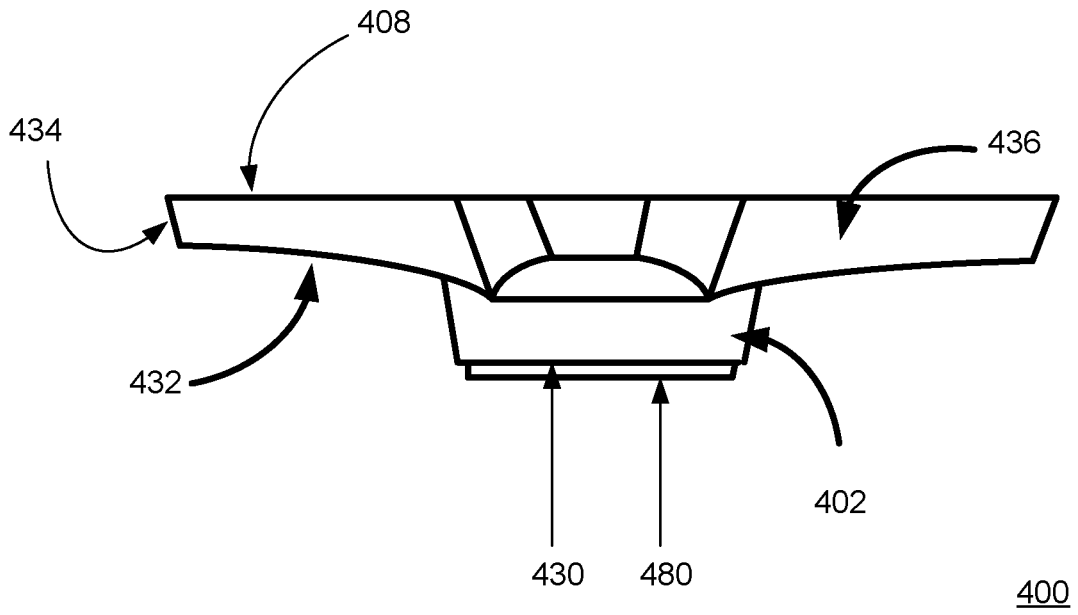
FIG. 20B is a second side view of a pedestal for a home cooking appliance according to an embodiment of the invention.
Figure 20C:
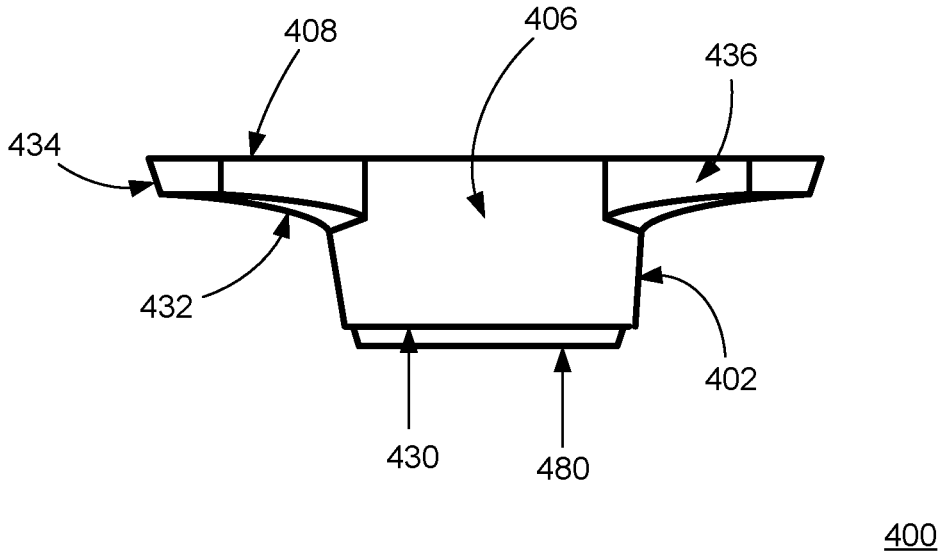
FIG. 20C is a third side view of a pedestal for a home cooking appliance according to an embodiment of the invention.
Figure 20D:
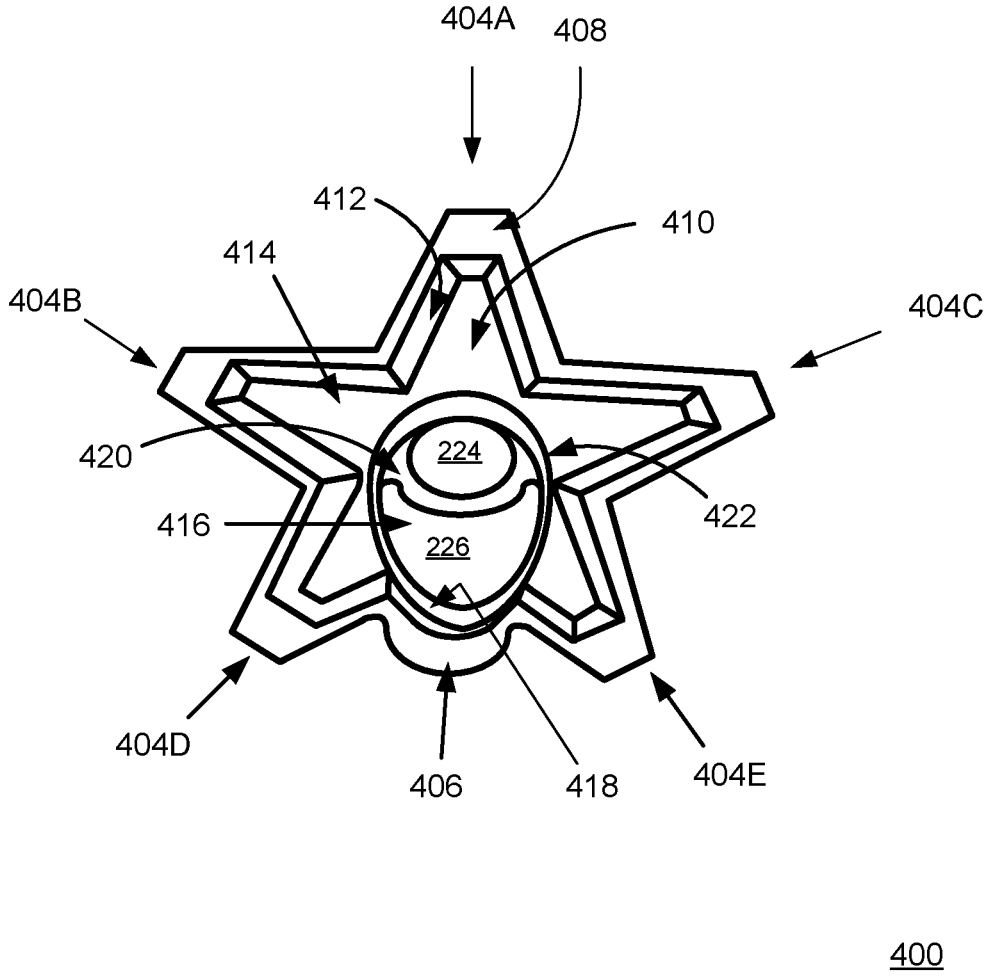
FIG. 20D is a top view of a pedestal for a home cooking appliance according to an embodiment of the invention.
Figure 20E:
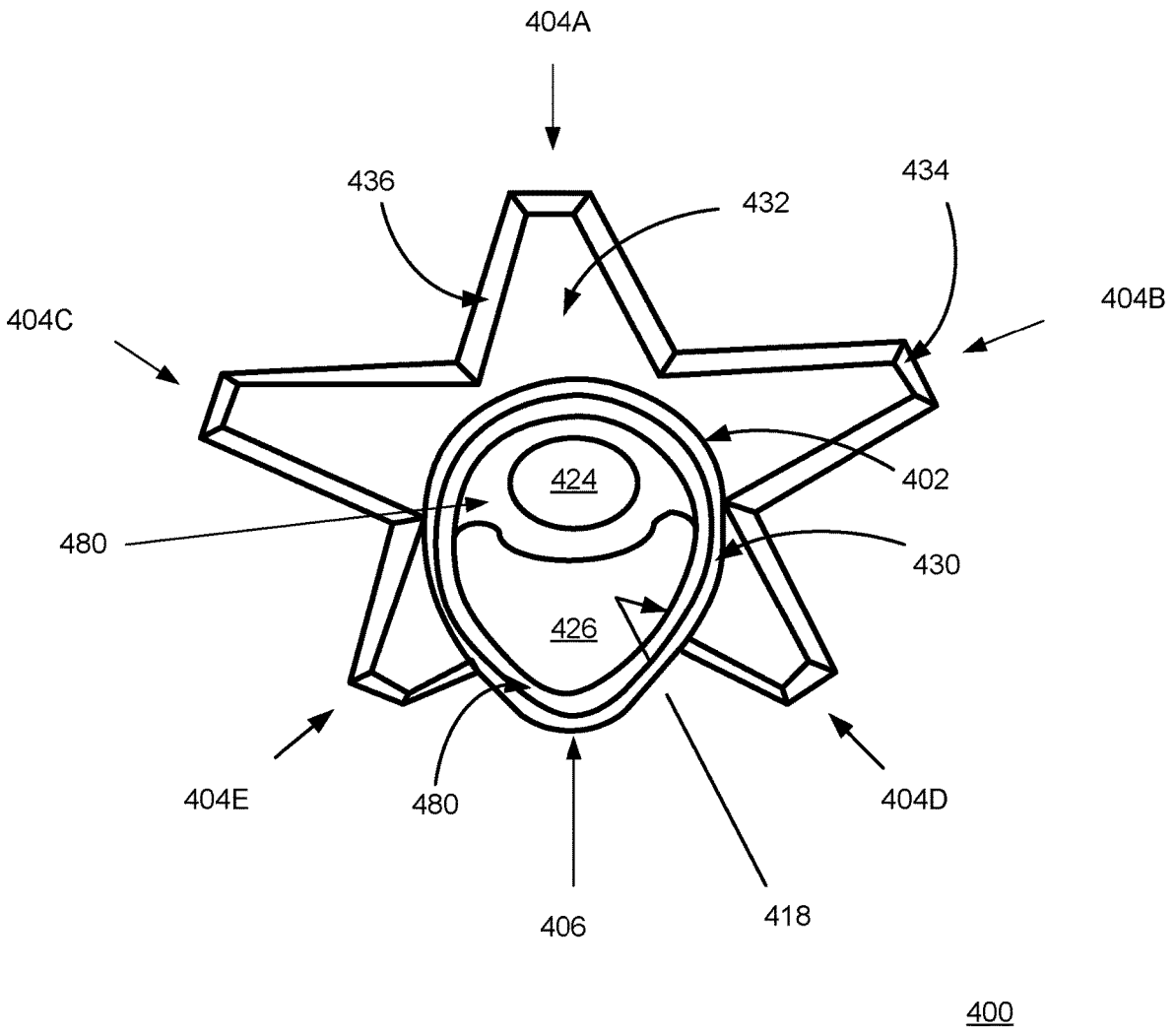
FIG. 20E is a bottom view of a pedestal for a home cooking appliance according to an embodiment of the invention.
Figure 20F:
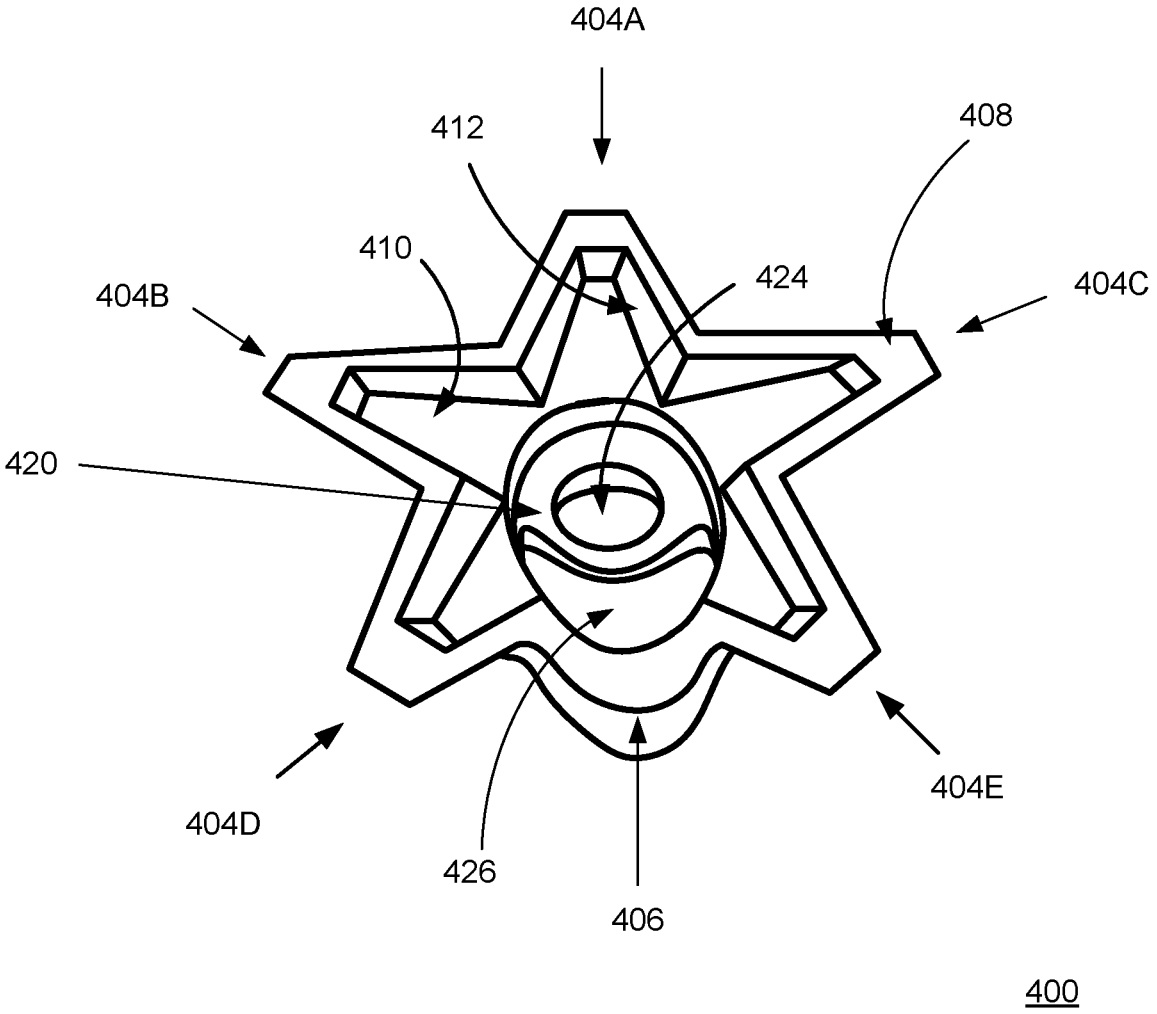
FIG. 20F is a perspective view of a pedestal for a home cooking appliance according to an embodiment of the invention.
Figure 20G:
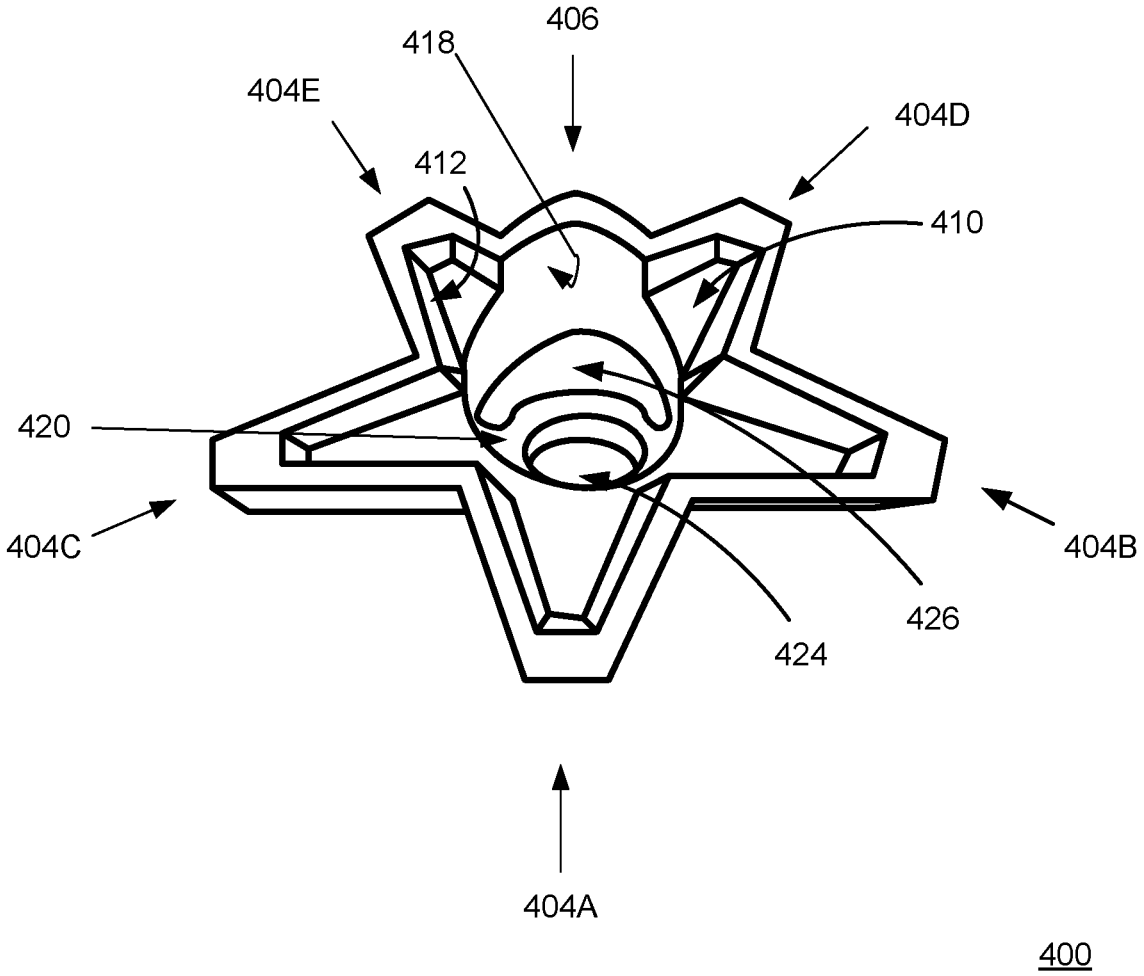
FIG. 20G is a perspective view of a pedestal for a home cooking appliance according to an embodiment of the invention.

FIGS. 19A and 19B illustrate a partially exploded view of a burner 120 having a burner portion 350, a pedestal portion 400, and a venturi tube 308 for facilitating flow of the air-gas mixture from the mixing zone 414 through the pedestal 400 and into the burner portion 350, where the air-gas mixture then exits the burner through the burner ports.

With reference to FIGS. 20A-20G, exemplary embodiments of a pedestal 400 will now be described.

The pedestal 400 can include an upper portion 404 that supports the burner body 350. The pedestal body or base portion 402 decouples the footprint of one or more of the upper portion 404 of the pedestal 400 and the burner body 350 of the burner 120 from the cooktop surface 114. The upper portion 404 can include a plurality of fingers (e.g., 404A, 404B, 404C, 404D, 404E). In this aspect, the upper portion 404 has five fingers that form a star configuration corresponding to the star configuration of the burner 120. One of ordinary skill in the art will recognize that other numbers of fingers and configurations can be provided. Other pedestal configurations also are possible. For example, the upper portion 404 of the pedestal 400 may have a circular or oval shaped configuration. The upper portion 404 and the base portion 402 can be integrally formed or separate parts, as shown for example in the exemplary embodiments illustrated in FIGS. 17-23.

Referring again to FIG. 17, the upper portion 404 of the pedestal 400 increases a horizontal distance X3 (e.g., a predetermined horizontal distance) between the flames of the burner 120 and the interface 250 between the pedestal 400 and the cooktop surface 114, thereby reducing or preventing the flame from the burner 120 from heating or baking a spill (e.g., a liquid or solid) onto the surface of the cooktop, and more particularly at the interface 250 which is more difficult to clean, and improving the ease with which the cooktop surface 114 may be cleaned.

Referring again to FIGS. 20A-20G, the pedestal 400 includes a pedestal body 402 having a lower surface 430 for mounting on the cooktop surface 114. In another aspect, the pedestal body 402 can include a recessed portion 480 for being received in an opening of the cooktop surface 114 to secure the pedestal to the cooktop surface 114. The pedestal 400 also includes an upper portion 404 formed on the pedestal body 402. The upper portion 404 can be integrally formed with the body portion 402 or coupled to the body portion 402. The upper portion 404 has a plurality of fingers (e.g., 404A, 404B, 404C, 404D, 404E). Each of the plurality of fingers of the upper portion 404 has a lower surface 432, an end surface 434, a pair of side surfaces 436, and an upper surface 408. The upper surface 408 receives or supports the burner body 350. In an aspect, one or more of the lower surface 432, the end surface 434, or the side surfaces 436 can be tapered or curved to improve flow of secondary air along the surface of the pedestal 400.

Referring to FIGS. 20D-20G, the pedestal 400 includes an upper cavity 414 formed in the upper portion 404 and a lower cavity 416 formed in the base portion 402. The upper cavity 414 is formed by a recessed surface 410 and an upper wall surface 412. In this aspect, the recessed surface 410 is angled with respect to a plane of the upper surface 408, or tapered downward toward the lower cavity 416, for example, to minimize or reduce the resistance to the flow of the additional volume of secondary air 80 in the pedestal 400. The upper wall surface 412 also may be angled or tapered with respect to the upper surface 408 and the recessed surface 410.

Figure 22:
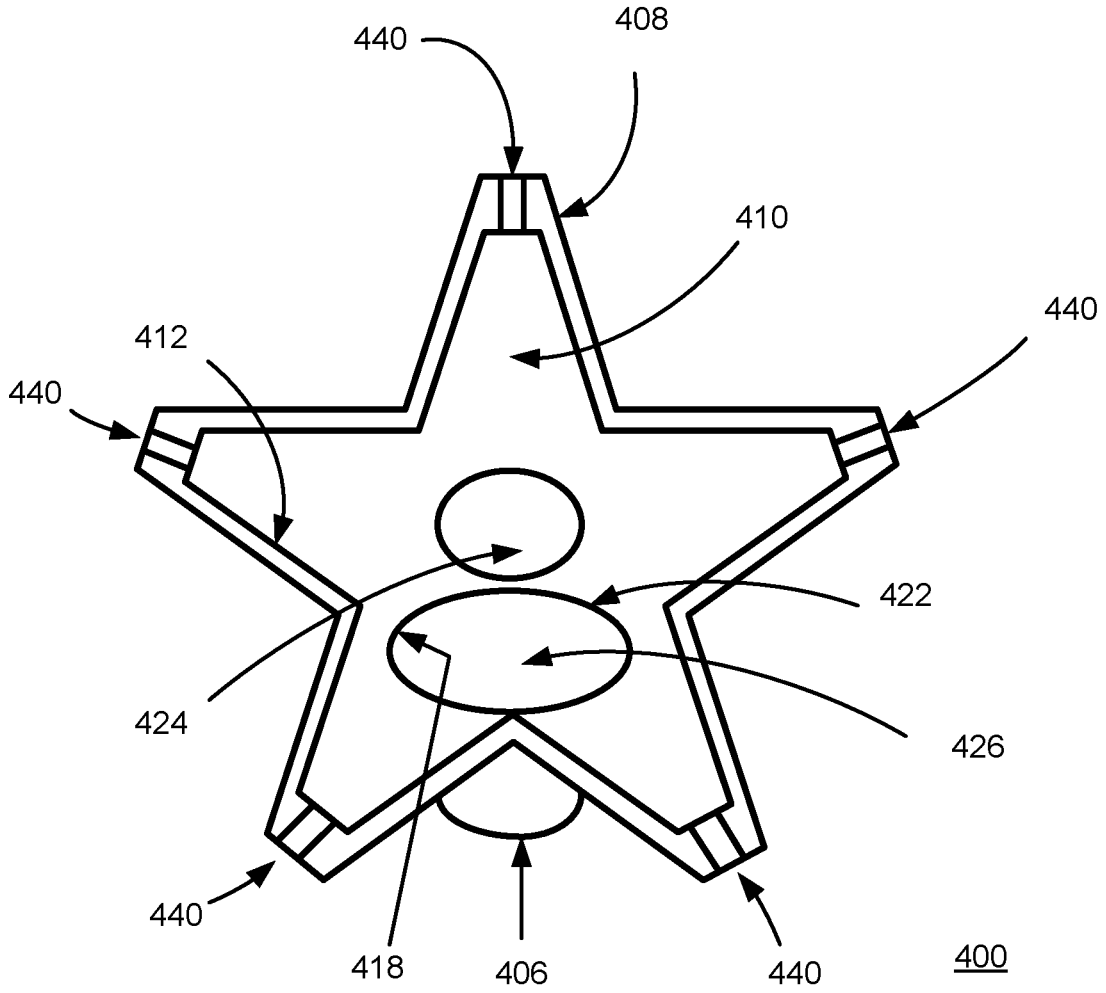
FIG. 22 is a top view of a pedestal for a home cooking appliance according to an embodiment of the invention.

Alternatively, the recessed surface 410 can be parallel to a plane of the upper surface 408 of the pedestal 400, as shown in the aspect illustrated in FIG. 22. In another aspect, the upper wall surface 412 can be perpendicular to the upper surface 408 and/or the recessed surface 410. One of ordinary skill in the art will recognize that various combinations of perpendicular, parallel, angled, tapered, and/or curved upper wall surfaces and recessed surfaces may be provided.

Referring again to FIGS. 20A-20G, the recessed surface 410 has an opening 422 such that the upper cavity 414 is in fluid communication with the lower cavity 416. The lower cavity 416 is defined by a lower wall surface 418 and an inside bottom surface 420. The inside bottom surface 420 includes a first opening 424 and a second opening 426 that extend through the lower surface 430 of the pedestal 400 such that the lower cavity 416 is in fluid communication with the exterior of the pedestal 400. The first opening 424 receives the venturi tube 308 (as shown in FIGS. 19A and 19B) for facilitating flow of the air-gas mixture from the mixing zone 414 through the pedestal 400 and into the burner 120, where the air-gas mixture then exits the burner through the burner ports 424. The second opening 426 facilitates flow of an additional volume of secondary air 80 from under the cooktop surface 114 through lower cavity 416 and upper cavity 414 of the pedestal 400 and out of the slots 240 of the pedestal to the flame 50.

In another aspect, the lower cavity 416 can be formed by the first opening 424 and the second opening 426, as shown in FIG. 22. One of ordinary skill in the art will recognize that various cavity configurations are possible for promoting the flow of the air-gas mixture through the pedestal 400 to the burner 120, and for promoting the flow of an additional volume of secondary air 80 from under the cooktop surface 114 to the flame 50.

Referring again to FIGS. 20A-20G, the pedestal 400 can include an integral ignitor support 406 that extends radially from a center of the star configuration and between two fingers of the star configuration of the pedestal. An ignitor 140 can be mounted on or in the ignitor support 406 for igniting the air-gas mixture of the burner 120. In other aspects, the ignitor support 406 may not be integrally formed with the pedestal 400. In these aspects, the ignitor and/or ignitor support can be separate from the pedestal and disposed adjacent to the pedestal at a height and/or distance that is sufficient for igniting the air-gas mixture from the burner 120.

Figure 21:
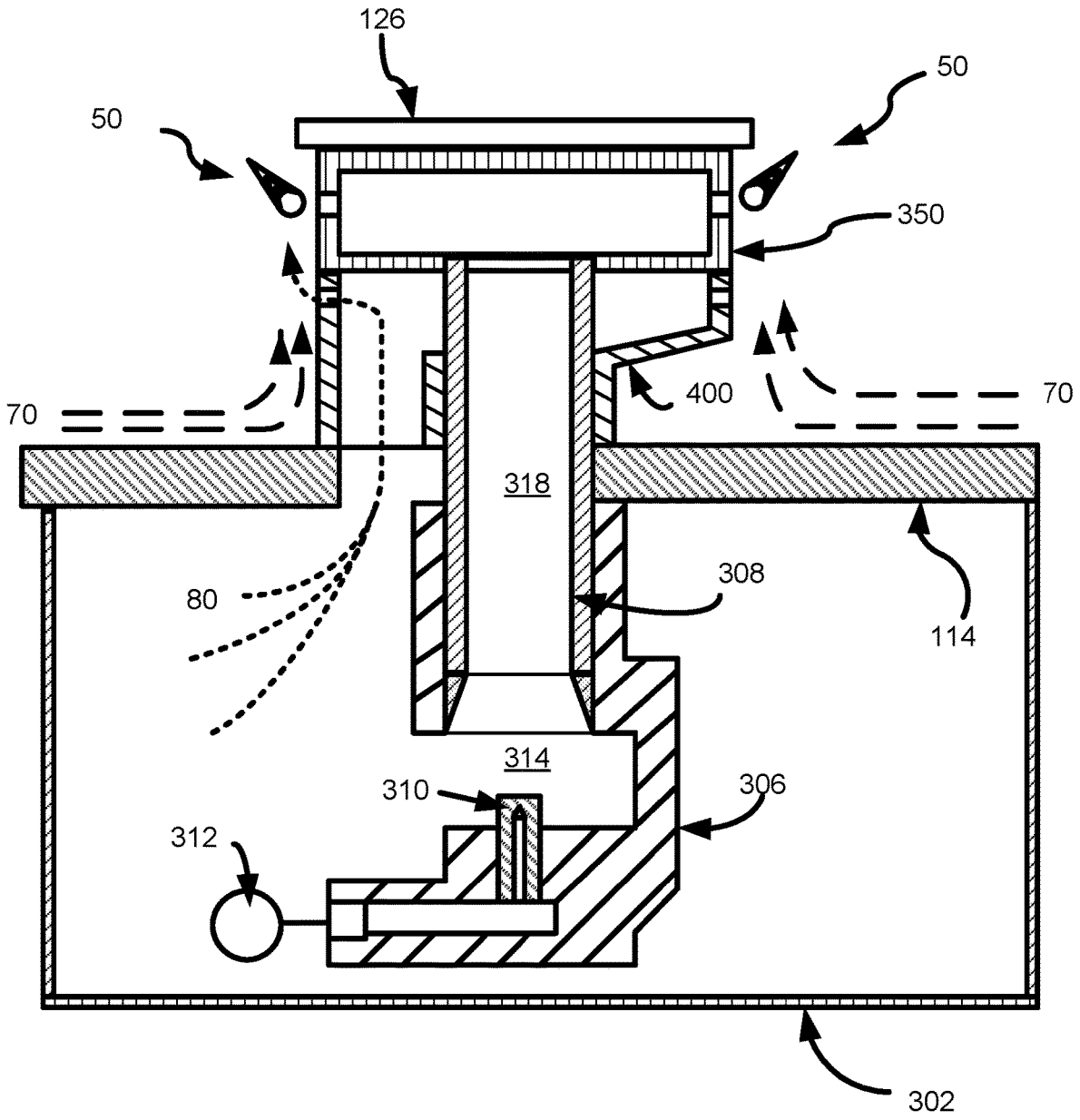
FIG. 21 is a partial cross-sectional view of a home cooking appliance according to an embodiment of the invention.

Referring to FIG. 21, the housing 112 has an interior box or a rough-in box 302 that encloses the cooktop controls and gas nozzle 310 inside a cooking appliance 100, such as a range, or under a cooktop for installation in a rough-in opening in a cabinet or countertop. The rough-in box 302 may include a bottom wall to prevent spillage through the cooktop openings from soiling the interior of the range or cabinet. In addition, the rough-in box 302 may provide support for a jet holder 306. An additional bracket also may be provided to support the jet holder 306.

As shown in FIG. 21, a venturi tube 308 includes an elongated body having a venturi passage 318. The body of the venturi tube 308 may include an exterior, threaded portion adapted to receive a nut to lock the venturi tube 308 into position in the opening of the cooktop surface 114, under the cooktop surface 114, or inside or on the pedestal 200. The lower end of the venturi tube 308 is received in a jet holder 306 and the upper end of the venturi tube 308 is received in an opening 424 of the pedestal 400, which will be described in greater detail below. The jet holder 306 may be supported by the rough-in box 302 or another support. The jet holder 306 may be mounted in the opening of the cooktop surface 114 or under the cooktop surface 114. The jet holder 306 positions a gas nozzle 310 for introducing gas for mixture with air and entry into the venturi passage 318 as is known conventionally. The nozzle 310 is coupled to a supply of gas 312 and discharges the fuel to a mixing zone 314 adjacent the entry to the venturi passage 318.

In operation, the supply of gas 312 is delivered through the nozzle 310 and mixed with air at the mixing zone 314. The air-gas mixture enters the venturi passage 318 for delivery to the burner 120. The air-gas mixture then passes through the burner ports 424 such that, upon ignition by an appropriate ignitor 140, a flame 50 may be initiated and sustained at the exterior of the burner cap 126 of the burner 120.

As shown in FIG. 21, aspects of the pedestal 400 can improve the flow of secondary air 70 to the flame 50. The pedestal 400 can include a plurality of slots 440 formed in the pedestal 400. The slots 440 may further improve flame production by providing access to an additional volume of secondary air 80 from within the pedestal 400 or under the pedestal 400 and the cooktop 114. It is noted that other arrangements of the burner 120, pedestal 400, venturi tube 308, and gas nozzle 310 may be provided without departing from the spirit and scope of the present invention. For example, in another aspect, the venturi tube 308 may be integrally formed with the pedestal 400.

Figure 23:
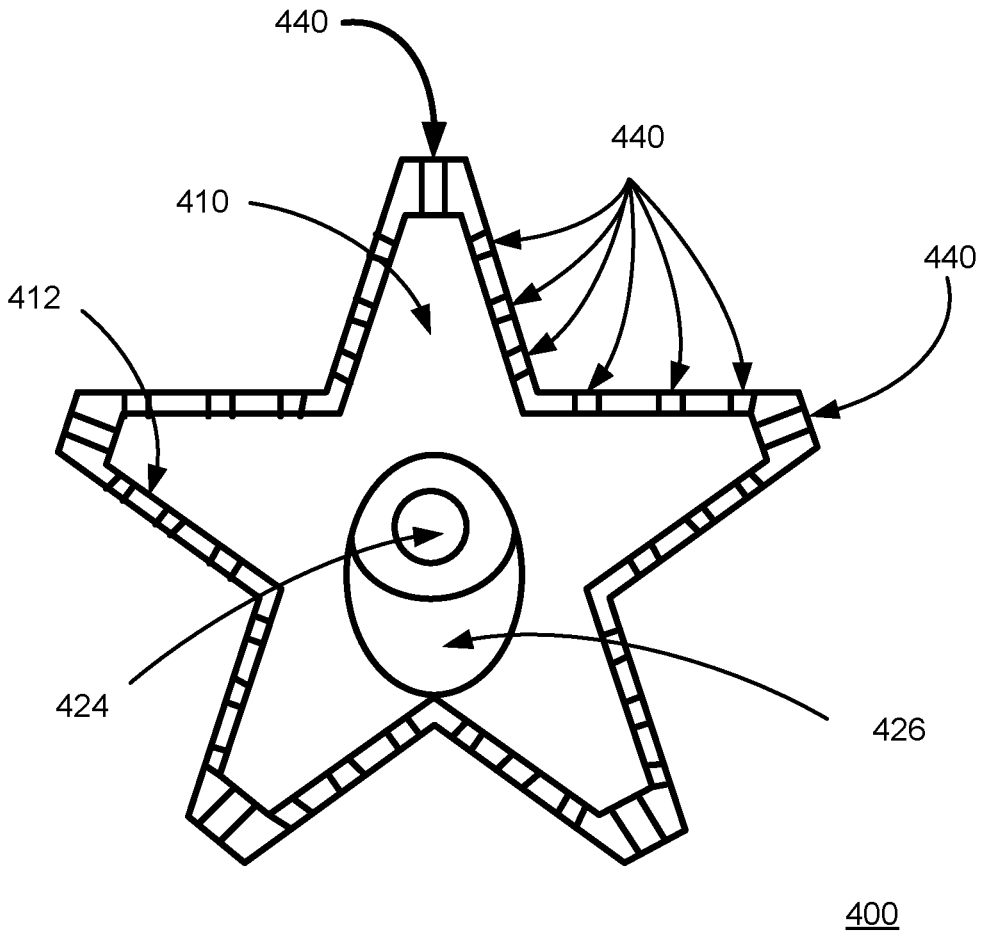
FIG. 23 is a top view of a pedestal for a home cooking appliance according to an embodiment of the invention.

Referring to FIGS. 22 and 23, the pedestal 400 can include a plurality of slots 440 formed in the upper portion 404 of the pedestal 400. The slots 440 provide fluid communication between the upper cavity 414 of the pedestal 400 and the exterior of the pedestal 400, which may improve flame production by providing access to an additional volume of secondary air 80 from within the pedestal 400 or under the pedestal 400 and cooktop 114. The slots 440 may be formed in one or more of the surfaces of the pedestal 400, such as the end surface 434 or the side surfaces 436. In other aspects, the slots 440 may be formed in the upper wall surface 412 of the pedestal 400. The slots 440 also may be configured to correspond to the locations of the burner ports 210 of the burner 120, which may further improve flame production.

In other aspects, the slots 440 can be formed in the lower surface 432 (e.g., through the recessed surface 410) and/or the base 402 (e.g., through the lower wall surface 118) of the pedestal 400 to provide access to an additional volume of secondary air 80 from within the pedestal 400 or under the pedestal 400 and cooktop 114. The slots 440 are illustrated as rectangular openings for illustrative purposes only. One of ordinary skill will recognize that the slots 440 formed in the pedestal 400 may have various cross-sectional shapes, depths, widths, spacings, and orientations with respect to each other and/or the direction of the fingers 404A-E of the pedestal 400. For example, the slots 440 can be square, curved, oval, circular, or V-groove shaped openings, or other shaped openings. Also, a plurality of holes in the surface or surfaces of the pedestal 400 can be provided in place of the slots 440. The holes can be circular, rectangular, square, or diamond shaped, as well as other suitable shapes.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing having a cooktop surface; and a sealed gas pedestal burner on the cooktop surface, wherein the sealed gas pedestal burner includes:

a burner portion having an exterior sidewall surface and an exterior underside surface, the exterior sidewall surface defining a plurality of burner ports, the exterior underside surface being beneath the burner ports; and a base portion having an exterior sidewall surface, wherein the base portion is sealed to the cooktop surface and interposes at least a portion of the burner portion and the cooktop surface and provides a vertical clearance between the exterior underside surface of the burner portion and the cooktop surface, and wherein an area of a footprint defined by a periphery of the exterior sidewall surface of the burner portion is greater than an area of a footprint defined by a periphery of an exterior surface of the base portion on the cooktop surface.

2. The home cooking appliance of claim 1, wherein the cooktop surface includes an intervening part, and wherein the base portion seals to the intervening part and interposes the burner portion and the intervening part of the cooktop surface and provides the vertical clearance between the exterior underside surface of the burner portion and at least one of the cooktop surface or the intervening part of the cooktop surface.

3. The home cooking appliance of claim 2, wherein the vertical clearance is a predetermined minimum vertical clearance between the exterior underside surface of the burner portion and the intervening part of the cooktop surface, the minimum vertical clearance extending a horizontal distance from an intersection of the exterior underside surface with the exterior sidewall surface of the burner portion to the exterior sidewall surface of the base portion.

4. The home cooking appliance of claim 2, wherein the exterior sidewall surface of the base portion is tapered such that a length of a periphery of the exterior sidewall surface of the base portion at a first intersection of the exterior sidewall surface of the base portion with the exterior underside surface of the burner portion is greater than a second intersection of the exterior sidewall surface of the base portion with the intervening part of the cooktop surface, thereby promoting airflow of secondary air in an upward direction extending from the cooktop surface along the exterior sidewall surface of the base portion toward the burner portion.

5. The home cooking appliance of claim 4, wherein the exterior sidewall surface of the base portion is continuously tapered.

6. The home cooking appliance of claim 2, wherein the base portion includes a lower mounting surface supported by the at least one of the cooktop surface or the intervening part disposed between the base portion and the cooktop surface.

7. The home cooking appliance of claim 2, wherein the base portion is configured to have a sealed arrangement between the at least one of the cooktop surface or the intervening part disposed between the base portion and the cooktop surface.

8. The home cooking appliance of claim 1, wherein the vertical clearance extends a horizontal distance from an intersection of the exterior underside surface with the exterior sidewall surface of the burner portion to the exterior sidewall surface of the base portion.

9. The home cooking appliance of claim 1, wherein the burner portion is separately formed from the base portion.

10. The home cooking appliance of claim 1, wherein the burner portion is integrally formed with the base portion.

11. The home cooking appliance of claim 1, wherein the exterior sidewall surface of the burner portion includes the plurality of burner ports.

12. The home cooking appliance of claim 1, wherein an upper edge of the exterior sidewall surface of the burner portion includes the plurality of burner ports.

13. The home cooking appliance of claim 1, wherein the burner portion includes a burner cap above the exterior sidewall surface.

14. The home cooking appliance of claim 13, wherein the burner cap includes a plurality of burner ports.

15. The home cooking appliance of claim 1, wherein the exterior sidewall surface of the base portion is tapered such that a length of a periphery of the exterior sidewall surface of the base portion at a first intersection of the exterior sidewall surface of the base portion with the exterior underside surface of the burner portion is greater than a second intersection of the exterior sidewall surface of the base portion with the cooktop surface, thereby promoting airflow of secondary air in an upward direction extending from the cooktop surface along the exterior sidewall surface of the base portion toward the burner portion.

16. The home cooking appliance of claim 1, wherein a length of a periphery of the exterior sidewall surface of the burner portion is greater than a length of a periphery of the exterior sidewall surface of the base portion.

17. The home cooking appliance of claim 1, wherein a shape of a footprint defined by a periphery of the exterior sidewall surface of the burner portion is one of a circular shape or an oval shape.

18. The home cooking appliance of claim 17, wherein a shape of a footprint defined by a periphery of the exterior sidewall surface of the base portion is one of a circular footprint, an oval footprint, or a tear-drop shaped footprint on the cooktop surface.

19. The home cooking appliance of claim 1, wherein the burner portion has a plurality of finger portions extending radially from a center of the burner portion, each of the plurality of finger portions comprising the exterior sidewall surface defining the plurality of burner ports.

20. The home cooking appliance of claim 19, wherein a shape of a footprint defined by a periphery of the exterior sidewall surface of the base portion is one of a circular footprint, an oval footprint, or a tear-drop shaped footprint on the cooktop surface.

21. The home cooking appliance of claim 1, wherein a shape defined by a periphery of the exterior sidewall surface of the burner portion is star-shaped.

22. The home cooking appliance of claim 21, wherein a shape of a footprint defined by a periphery of the exterior sidewall surface of the base portion is one of a circular footprint, an oval footprint, or a tear-drop shaped footprint on the cooktop surface.

23. The home cooking appliance of claim 1, wherein a shape defined by a periphery of the exterior sidewall surface of the base portion is one of a circular footprint, an oval footprint, or a tear-drop shaped footprint on the cooktop surface.

24. The home cooking appliance of claim 1, wherein a shape defined by a periphery of the exterior sidewall surface of the burner portion is different from a shape of a footprint defined by a periphery of the exterior sidewall surface of the base portion on the cooktop surface.

25. The home cooking appliance of claim 1, wherein the cooktop surface includes an integral volcano-type pedestal, and wherein the base portion interposes at least the portion of the burner portion and the integral volcano-type pedestal of the cooktop surface.

26. The home cooking appliance of claim 1, wherein the cooktop surface includes an opening under the base portion of the sealed gas pedestal burner, wherein the burner portion includes a cavity in fluid communication with the plurality of burner ports, and wherein the base portion includes a passageway fluidly connecting the opening in the cooktop surface to the cavity of the burner portion.

27. The home cooking appliance of claim 26, further comprising a venturi tube, wherein the passageway is defined by sidewalls of the venturi tube, the sidewalls of the venturi tube being different from the sidewalls of the base portion.

28. The home cooking appliance of claim 1, wherein the base portion includes a lower mounting surface directly supported by the cooktop surface.

29. A home cooking appliance comprising:

a housing having a cooktop surface; and a sealed gas pedestal burner on the cooktop surface, wherein the sealed gas pedestal burner includes:

a base portion on the cooktop surface, the base portion having an exterior sidewall surface disposed above the cooktop surface; and a burner portion above the base portion, the burner portion having an exterior sidewall surface and an exterior underside surface facing the cooktop surface, the exterior sidewall surface defining a plurality of burner ports, the exterior underside surface being beneath the burner ports, wherein the base portion elevates the burner portion above the cooktop surface and provides a vertical clearance between the exterior underside surface of the burner portion and the cooktop surface, wherein the base portion is sealed to the cooktop surface, and wherein an area of a footprint defined by a periphery of the exterior sidewall surface of the burner portion is greater than an area of a footprint defined by a periphery of an exterior surface of the base portion on the cooktop surface.

30. The home cooking appliance of claim 29, further comprising a venturi tube fluidically connecting the burner portion to an underside of the cooktop surface.

* * * * *